US008087556B2

(12) United States Patent
Oomori et al.

(10) Patent No.: US 8,087,556 B2
(45) Date of Patent: Jan. 3, 2012

(54) POWER TOOL

(75) Inventors: Katsuhiro Oomori, Ibaraki (JP); Tomoyuki Hoshi, Ibaraki (JP); Hideki Ishida, Ibaraki (JP); Masato Sakai, Ibaraki (JP); Takuya Teranishi, Ibaraki (JP); Takeshi Taniguchi, Ibaraki (JP); Takuma Saito, Ibaraki (JP); Naoki Tadokoro, Ibaraki (JP); Hideyuki Hashimoto, Ibaraki (JP); Akira Oono, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 244 days.

(21) Appl. No.: 11/944,512

(22) Filed: Nov. 23, 2007

(65) Prior Publication Data

US 2008/0185410 A1 Aug. 7, 2008

(30) Foreign Application Priority Data

Nov. 24, 2006 (JP) ..... P2006-316895

(51) Int. Cl.
*B25F 5/00* (2006.01)
*A45F 5/00* (2006.01)

(52) U.S. Cl. ..... 224/269; 224/272; 224/904

(58) Field of Classification Search ..... 224/268, 224/269, 272, 904; 248/690–692; 173/170
See application file for complete search history.

(56) References Cited

U.S. PATENT DOCUMENTS

| | | | | |
|---|---|---|---|---|
| 4,889,307 | A * | 12/1989 | Klansek | 248/690 |
| 2002/0122707 | A1* | 9/2002 | Sakai et al. | 408/241 R |
| 2004/0050888 | A1* | 3/2004 | Warner | 224/269 |
| 2005/0015935 | A1 | 1/2005 | Bader et al. | |

FOREIGN PATENT DOCUMENTS

| | | | |
|---|---|---|---|
| DE | 10 2004 032 788 | A1 | 2/2006 |
| EP | 1 645 372 | A1 | 4/2006 |
| JP | 11-129170 | | 5/1999 |
| JP | 2000-176862 | A | 6/2000 |
| JP | 2001-162566 | | 6/2001 |
| JP | 2002-254358 | | 9/2002 |
| JP | 2006272486 | | 10/2006 |
| WO | WO 2004/048046 | A1 | 6/2004 |

OTHER PUBLICATIONS

European Search Report issued in European Patent Application No. EP 07022703.8 dated Dec. 29, 2009.

Japanese Notification of Reasons for Refusal, w/ English translation thereof, issued in Japanese Patent Application No. JP 2006-316895 dated Oct. 12, 2010.

* cited by examiner

*Primary Examiner* — Justin Larson
*Assistant Examiner* — Adam Waggenspack
(74) *Attorney, Agent, or Firm* — McDermott Will & Emery LLP

(57) ABSTRACT

An electric driver includes a hook portion which is constituted by a deformable hook-like portion and a connecting portion for connecting the hook-like portion to the handle. The hook-like portion is constituted by a base portion connected to the connecting portion and a bent portion continuous to the base portion, and a front end portion continuous to the bent portion and arranged at a position substantially opposed to the base portion. The front end portion and the base portion can be proximate to and remote from each other. The connecting portion holds the hook-like portion in a direction substantially the same as a direction in which the handle extends. The hook-like portion is pivotably held on a first rotating axis center extending in substantially the same direction as the handle.

5 Claims, 39 Drawing Sheets

POWER TOOL

CROSS-REFERENCE TO RELATED APPLICATIONS

This application is based on and claims the benefit of priority from the prior Japanese Patent Application No. 2006-316895, filed on Nov. 24, 2006; the entire contents of which are incorporated herein by reference.

BACKGROUND

1. Technical Field

The present invention relates to a power tool, particularly to a portable power tool.

2. Description of Related Art

In a related art, in a power tool, for example, an electric impact driver of a charge type, a nailing machine of a pneumatic type or the like, a user carried out an operation by holding the power tool by the hand, and when the power tool is not used, the user holds the power tool by hanging the power tool from a belt, a safety belt or the like of the user. It is disclosed by, for example JP-A-2002-254358, that the power tool is provided with a hook portion for hanging the power tool to a belt or the like.

SUMMARY

When a user does not use a power tool over a long period of time in carrying out an operation or when the user carries out the operation at a narrow operating site, even in a state of being hung from a belt or the like, the power tool constitutes a hindrance, and therefore, the operator places the power tool at another site. In this case, when the hook portion is hung from the belt or the like, an opening of the hook portion is small, and therefore, the power tool cannot be hung from, for example, a single pipe or the like for integrating a scaffold. Although when the hook portion is enlarged, the hook portion can also be hung from a single pipe or the like, when the hook portion is enlarged, in normally using the power tool, the hook portion constitutes a hindrance and even when hung from a belt or the like, a mountability thereof is inferior. Therefore, it is an object of the invention to provide a power tool capable of being hung with various widths of the hook portion and having an excellent operability.

In order to resolve the above-described problem, the invention provides a power tool characterized in comprising a main body portion having an output portion, a grabbing portion provided by being extended from the main body portion, and a hook portion rectified by the grabbing portion, wherein the hook portion is constituted by a hook-like portion and a connecting portion for connecting the hook-like portion to the grabbing portion, wherein the hook-like portion is constituted substantially by a shape of a fishing hook by a base portion connected to the connecting portion and a bent portion continuous to the base portion and a front end portion continuous to the bent portion and arranged at a position substantially opposed to the base portion and constituted by a plastically deformable material and the front end portion and the base portion are made to be able to be proximate to and remote from each other, and wherein the connecting portion holds the hook-like portion in a state of being hung down in a direction substantially the same as a direction of extending the grabbing portion and the hook-like portion is held centering on a first pivoting axis center extended in the direction of hanging down the hook-like portion pivotably relative to the grabbing portion.

According to the constitution, at the hook-like portion, a width between the base portion and the front end portion can be changed in accordance with a width of a member from which the power tool is hung. The connecting portion supports the hook-like portion pivotably, and therefore, the hook-like portion can be folded so as not to be projected excessively from a surface of the power tool.

In the above-described constitution, it is preferable that the connecting portion is rectified with a second pivoting axis center intersected with the first pivoting shaft and the hook-like portion is held pivotably around the second pivoting axis center.

According to one aspect of the invention, when hanging the power tool by the hook-like portion, the main body portion and the like can pivot like a pendulum about the second pivoting axis center, the second pivoting axis center serving as a fulcrum.

Further, it is preferable that the grabbing portion includes a pinching portion capable of pinching the front end portion of the hook-like portion. According to the constitution, when the front end portion of the hook-like portion is folded to be attached to the grabbing portion, the front end portion can be held by the pinching portion.

Further, it is preferable that the hook portion is provided at a front end portion in a direction of extending the grabbing portion. According to the constitution, when the power tool is hung by the hook-like portion, the main body portion can be disposed on a lower side of the hook-like portion.

Further, it is preferable that the output portion includes an output shaft portion, wherein the grabbing portion extends from the main body portion in a direction which intersects a direction of an output shaft of the output shaft portion, and wherein the second pivoting axis center is extended in a direction substantially orthogonal to the direction of the output shaft and the direction in which the grabbing portion extends.

According to one aspect of the invention, two intersecting shafts can be provided between the hook-like portion and the grabbing portion. Therefore, the hook-like portion can be pivoted around a first shaft and can be pivoted around a second shaft intersected with the first shaft, and therefore, a locus of pivoting a front end of the hook-like portion can three-dimensionally be constituted.

According to one aspect of the invention, the power tool can be hung with various widths of the hook portion and an operability of the power tool can excellently be maintained.

BRIEF DESCRIPTION OF THE DRAWINGS

In the accompanying drawings.

DESCRIPTION OF THE EMBODIMENTS

Figure 1:
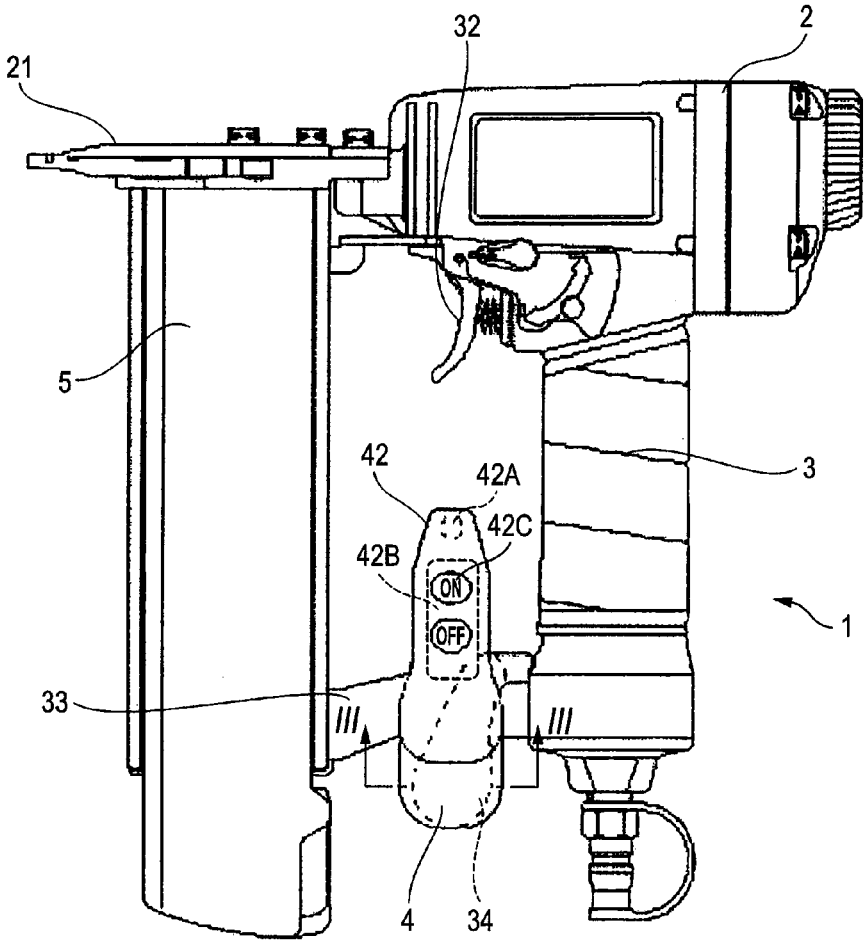
FIG. 1 a side view of a state of operating a power tool according to a first embodiment of the invention.

A power tool according to a first embodiment of the invention will be explained in reference to FIG. 1 through FIG. 7. As shown by FIG. 1, according to the first embodiment, a nailing machine 1 constituting a power tool constituting power by compressed air will be explained.

The nailing machine 1 is mainly constituted by a main body portion 2, a handle 3, a hook portion 4, and a magazine 5. The main body portion 2 includes a piston or the like, not illustrated, constituting an output portion and a nose 21 is provided at a front end portion of the main body portion 2. Inside of the nose 21 is provided with a blade, not illustrated, constituting the output portion driven by a piston, not illustrated. A blade, not illustrated, is made to be able to be slid reciprocally in a direction of an output shaft constituting a direction directed from the main body portion 2 to the nose 21.

The handle 3 constitutes a grabbing portion and extended from a side face portion of the main body portion 2 in a direction of being intersected with the direction of the output shaft. The handle 3 includes a trigger 32 at a base end portion of the extension and the piston, not illustrated, is controlled to drive by the trigger 32. A front end in the direction of extending the handle 3 is provided with a holding portion 33 for holding the magazine 5. The holding portion 33 is provided with a hook support portion for supporting the hook portion 4.

The hook portion 4 is mainly constituted by a shaft support portion 31 (FIG. 2), a shaft portion 41 (FIG. 3) supported by the shaft support portion 31 and an arm portion 42 (FIG. 1) provided at an end portion of the shaft portion 41.

Figure 2:
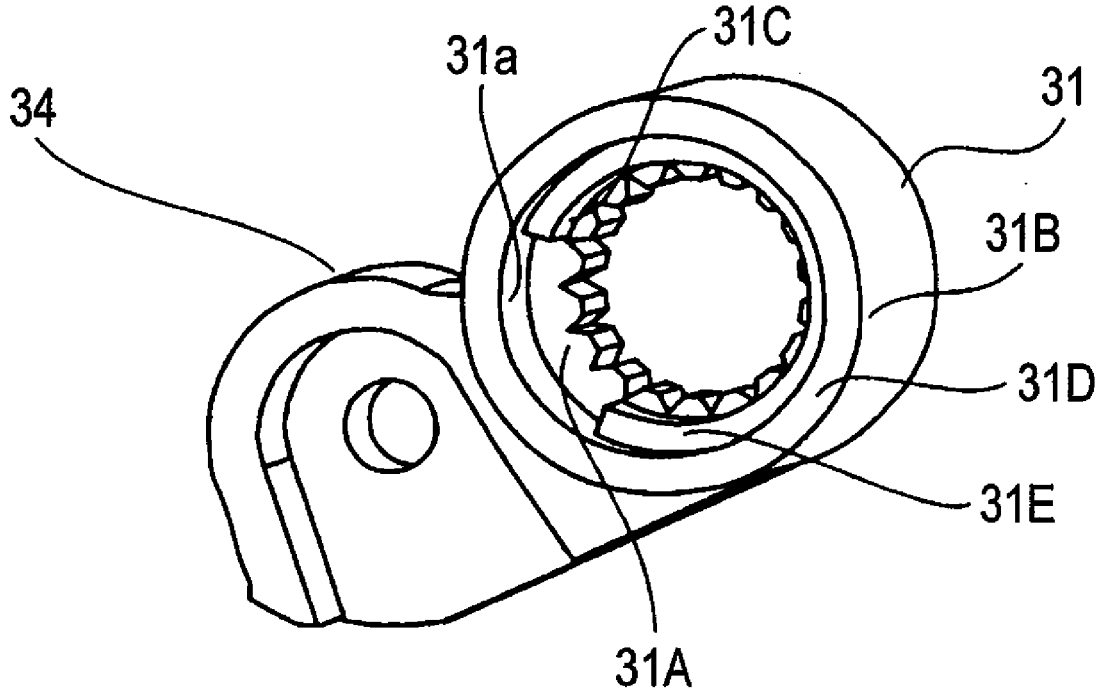
FIG. 2 is a perspective view showing a periphery of a shaft support portion of the power tool according to the first embodiment of the invention.

As shown by FIG. 2, the shaft support portion 31 is constituted integrally with a hook support portion 34 and substantially in a cylindrical shape and formed with a support hole 31*a*. In a state of providing the hook support portion 34 at the holding portion 33, the support hole 31*a* is penetrated in a direction substantially orthogonal to both of the direction of the output shaft and the direction of extending the handle 3.

Figure 3:
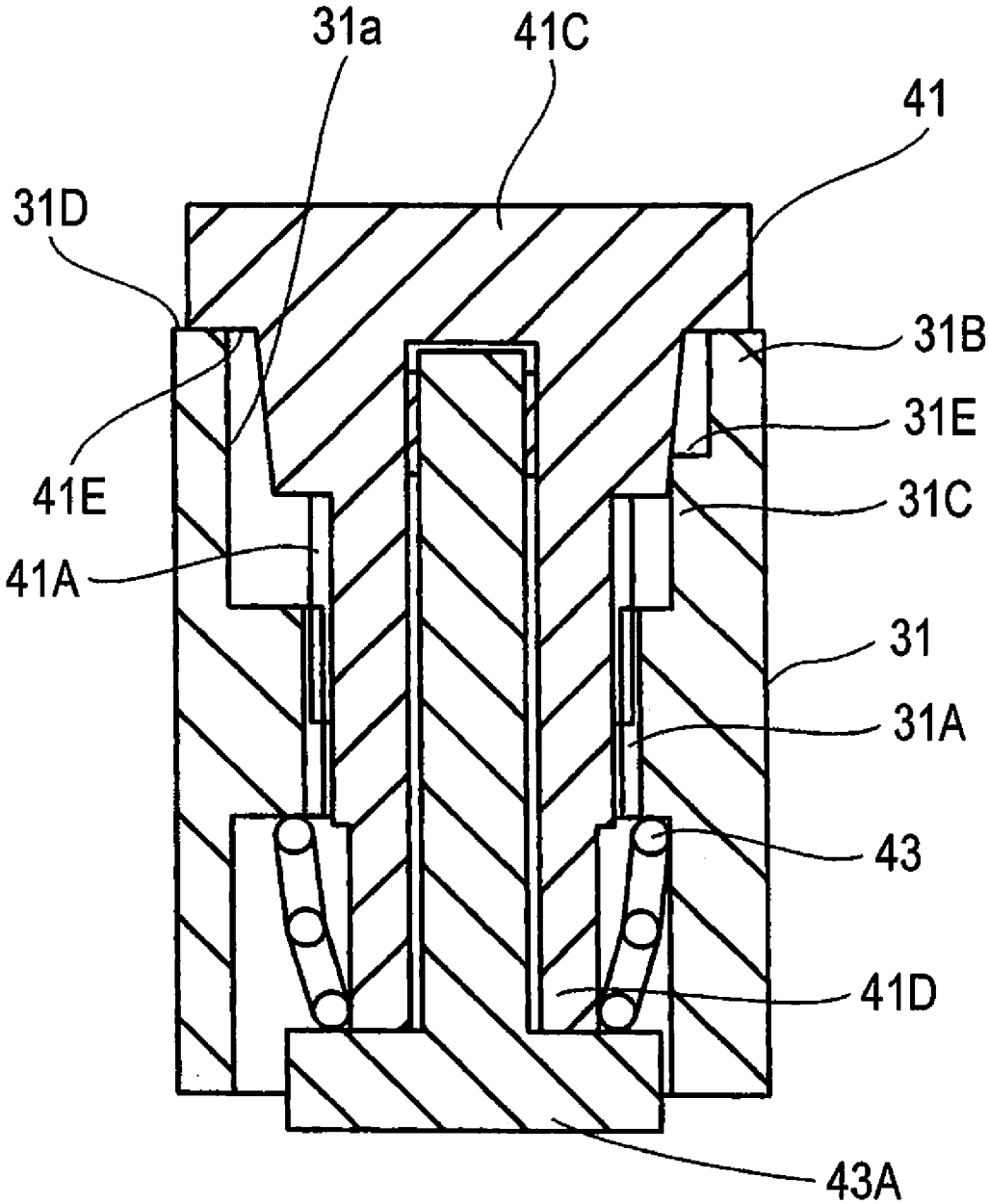
FIG. 3 is a sectional view taken along a line III-III of FIG. 1 (first position)

As shown by FIGS. 2 and 3, an inner face of a substantially center portion in the penetrated direction of the support hole 31*a* is provided with inner teeth 31A in a ring-like shape continuously over a peripheral direction of the inner face. According to the inner teeth 31A, a diameter of an inner periphery thereof is constituted to be smaller than a diameter of an opening portion of the support hole 31*a*. Further, a first position rectifying portion 31B is at one side edge portion in the penetrating direction of the support hole 31*a* of the shaft support portion 31 and a peripheral edge portion of the opening of the support hole 31*a*.

As shown by FIG. 3, there is provided a second position rectifying portion 31C having a section orthogonal to the penetrating direction of the support hole 31*a* substantially in a C-like shape at a position of the inner face of the support hole 31*a* brought into contact with the inner teeth 31A from one side of the penetrating direction of the support hole 31*a*. The second position rectifying portion 31C is constituted such that a diameter of an inner periphery of the substantially C-like shape is smaller than a diameter of an opening portion of the support hole 31*a*. Further, the second position rectifying portion 31C is constituted such that the inner teeth 31A can be viewed at inside of the second position rectifying portion 31C in a state of viewing the shaft support portion 31 from the penetrating direction of the support hole 31*a*. An engaged portion is constituted from the first position rectifying portion 31B and the second position rectifying portion 31C.

Further, in the first position rectifying portion 31B, a face constituting an end face of the shaft support portion is rectified as a first position rectifying face 31D. A side face of the second position rectifying portion 31C and a face substantially in parallel with the first position rectifying face 31D is rectified as a second position rectifying face 31E.

Figure 4:
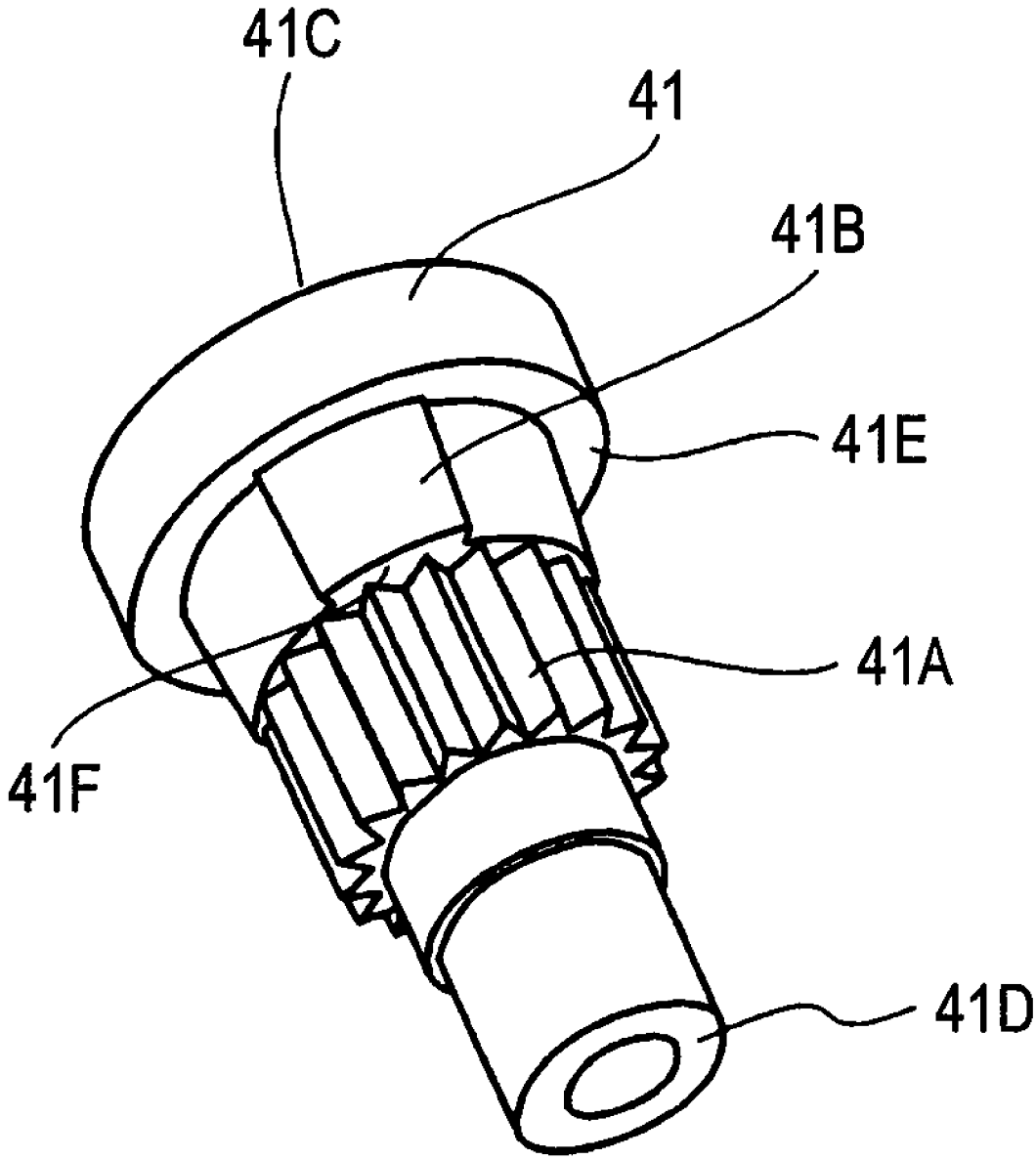
FIG. 4 is a perspective view showing a shaft portion of the power tool according to the first embodiment of the invention.

As shown by FIG. 3 and FIG. 4, the shaft portion 41 is constituted substantially by a shape of a circular column by mainly including an outer teeth 41A, a projected portion 41B, a flange portion 41C and a female screw portion 41D. The outer teeth 41A are provided at substantially a center portion in an axial direction of the shaft portion 41 over a total of an outer periphery thereof and made to be able to be brought in mesh with the inner teeth 31A. The female screw portion 41D is disposed on a front end side in an inserting direction of inserting the shaft portion 41 to the support hole 31*a* and is made to be able to be screwed with a male screw 43A. Further, a length in the axial direction of the outer teeth 41A is constituted to be able to be screwed with the inner teeth 31A even in a state in which the shaft portion 41 is disposed at either of a first position and a second position mentioned later.

The flange portion 41C is provided on a rear side in the direction of inserting the shaft portion 41 and supports the arm portion 42 (FIG. 1). Further, at the flange portion 41C, a first contact portion 41E is rectified at a face thereof opposed to the shaft support portion 31. In the hook portion 4, a state of bringing the first contact portion 41E and the first position rectifying face 31D into contact with each other is rectified as the first position.

As shown by FIG. 4, the projected portion 41B is provided by being projected from the surface of the shaft portion 41 between the flange portion 41C and the outer teeth 41A. A diameter of the shaft portion 41 at a position of providing the projected portion 41B is constituted to be substantially the same as or slightly smaller than the inner diameter of the second position rectifying portion 31C, and an amount of projecting the projected portion 41B is constituted by a length capable of being inserted to the opening portion substantially in the C-like shape of the second position rectifying portion 31C in a state of inserting the shaft portion 41 to the support hole 31*a*. Further, the projected portion 41B is constituted such that the shaft portion 41 can be pivoted to some degree in a state of being inserted to the opening portion substantially in the C-like shape of the second position rectifying portion 31C.

A second contact portion 41F constituting a face substantially orthogonal to the inserting direction is provided at a position of the projected portion 41B at a vicinity of the outer teeth 41A. In the hook portion 4, a state of bringing the second contact portion 41F into contact with the second position rectifying face 31E is rectified as the second position. Further, an engaging portion is constituted by the first contact portion 41E and the second contact portion 41F.

The arm portion 42 shown in FIG. 1 is connected to the flange portion 41C constituting the position of the front end of the shaft portion 41 (FIG. 3) in the direction of extending the shaft portion 41 from the shaft support portion 31, and is arranged substantially orthogonal to the axial direction of the shaft portion 41. The front end portion of the arm portion 42 in the extending direction from the shaft portion 41 is provided with LED 42A of yellow color having an optical axis extended in the extending direction. A barrel portion of the arm portion 42 includes a battery 42B and electricity is supplied from the battery 42B to LED 42A. Further, a switch 42C at a surface of the barrel portion of the arm portion 42 and electricity supplied from the battery 42B can be made ON/OFF. Therefore, a constitution related to irradiation is completed only by the arm portion 42. The arm portion 42 is connected to the shaft portion 41 (FIG. 3), and therefore, a distance between the arm portion 42 and the handle 3 can be set selectively to two kinds of distances by moving the shaft portion 41 to the first position and the second position.

Figure 5:
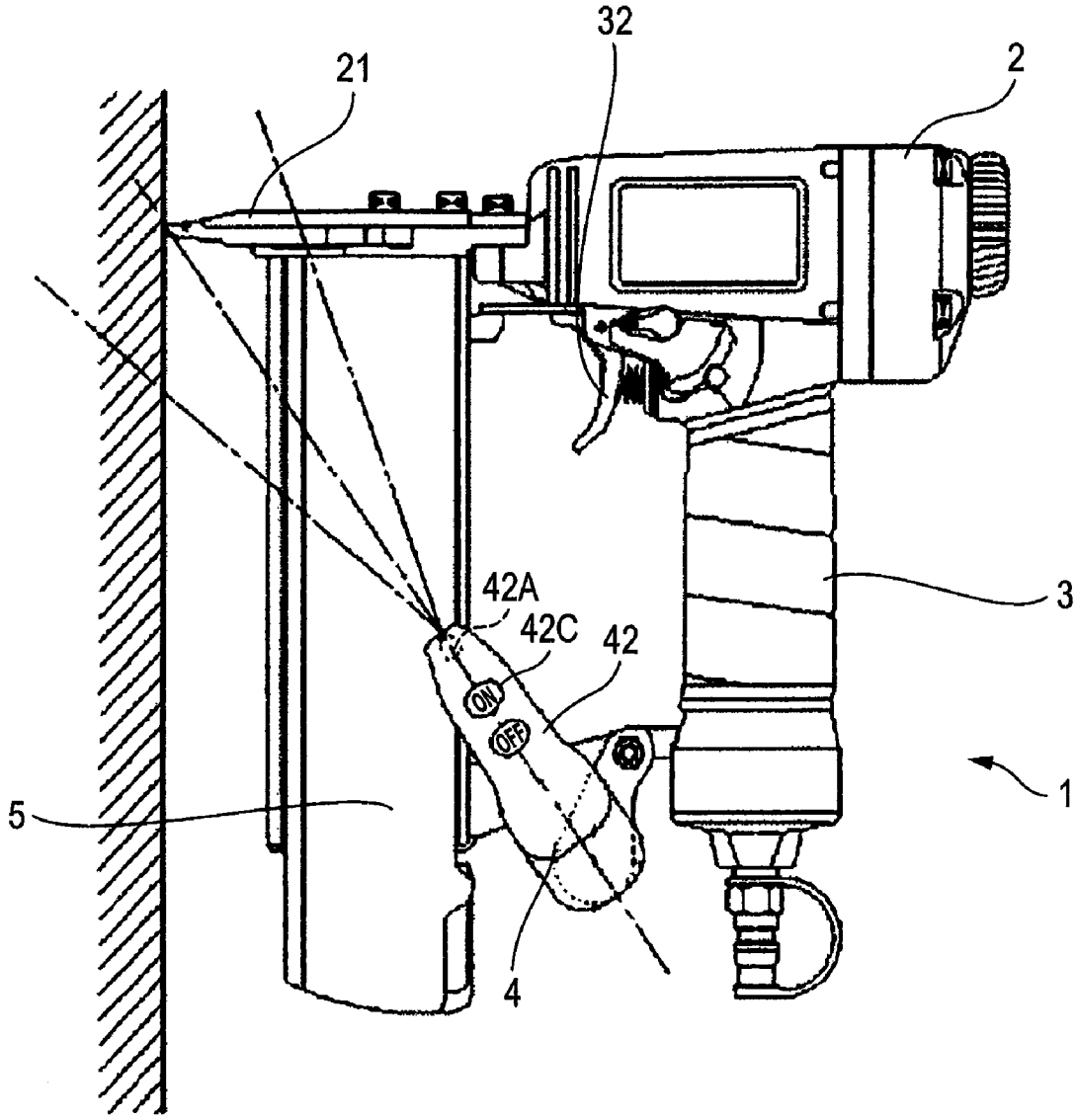
FIG. 5 is a side view when an illumination of the power tool according to the first embodiment of the invention is lighted.

In a state of inserting the shaft portion 41 to the support hole 31*a* of the shaft support portion 31 from one side, the male screw 43A is inserted from other side to be screwed to the shaft portion 41 by the female screw portion 41D. In a state of screwing the male screw 43A, a coil spring 43 is arranged between a flange portion of the male screw 43A and the inner teeth 31A of the shaft support portion 31. Therefore, the male screw 43A is urged in the axial direction of the shaft portion 41 in a direction of being projected from an opening on other side of the support hole 31*a* by the coil spring 43. The male screw 43A is screwed with the shaft portion 41, and therefore, an urge force thereof is operated to the shaft portion 41, and the shaft portion 41 is urged in a direction of being directed from one side to other side, that is, in a direction of being inserted into the shaft support portion 31. Therefore, the inner teeth 31A and the outer teeth 41A are always brought in mesh with each other so far as an external force is not exerted by pulling the shaft portion 41 in the extending direction or the like. Further, as shown by FIG. 5, a position of an opening portion of the second position rectifying portion 31C and a position of the projected portion 41B are arranged such that the projected portion 41B can be arranged at inside of the opening of the second position rectifying portion 31C in a state in which the arm portion 42 is extended to the side of the nose 21 in view from the shaft portion 41.

The magazine 5 is held by the nose 21 and the holding portion 33 and supplies a nail included at inside of a path of reciprocating the blade, not illustrated, at inside of the nose 21.

When an operation is executed by the nailing machine 1 in the above-described constitution, as shown by FIG. 3, the shaft portion 41 is disposed at the first position. Further, as shown by FIG. 5, a periphery of the nose 21 is irradiated by a light ray irradiated from LED 42A. Thereby, a portion of an execution member to which a nail is struck is irradiated and an optical recognizability of an executed portion can be promoted. Further, LED 42A is yellow color LED, and therefore, the optical recognizability is further promoted. Further, in a state in which the projected portion 41B is inserted to the opening portion substantially in the C-like shape of the second position rectifying portion 31C and the first contact portion 41E and the first position rectifying face 31D are brought into contact with each other, that is, at the first position, the shaft portion 41 can adopt a plurality of angles by releasing the inner teeth 31A and the outer teeth 41A from being brought in mesh with each other, and therefore, also an irradiating position of LED 42A can be changed to some degree, and irradiation can be carried out over a wider range.

Further, in the state in which the shaft portion 41 is disposed at the first position, the arm portion 42 is directed to a side of the nose 21. That is, since the hook portion 4 is provided at the front end portion in the extending direction from the main body portion 2 of the handle 3, and therefore, when the nailing machine 1 is hung from a hung member by the hook portion 4, the nailing machine 1 can be hung in a state in which a side of the main body portion 2 is hung down by the hook portion 4. Therefore, the nailing machine 1 can stably be hung from, for example, a belt of pants or the like.

Figure 6:
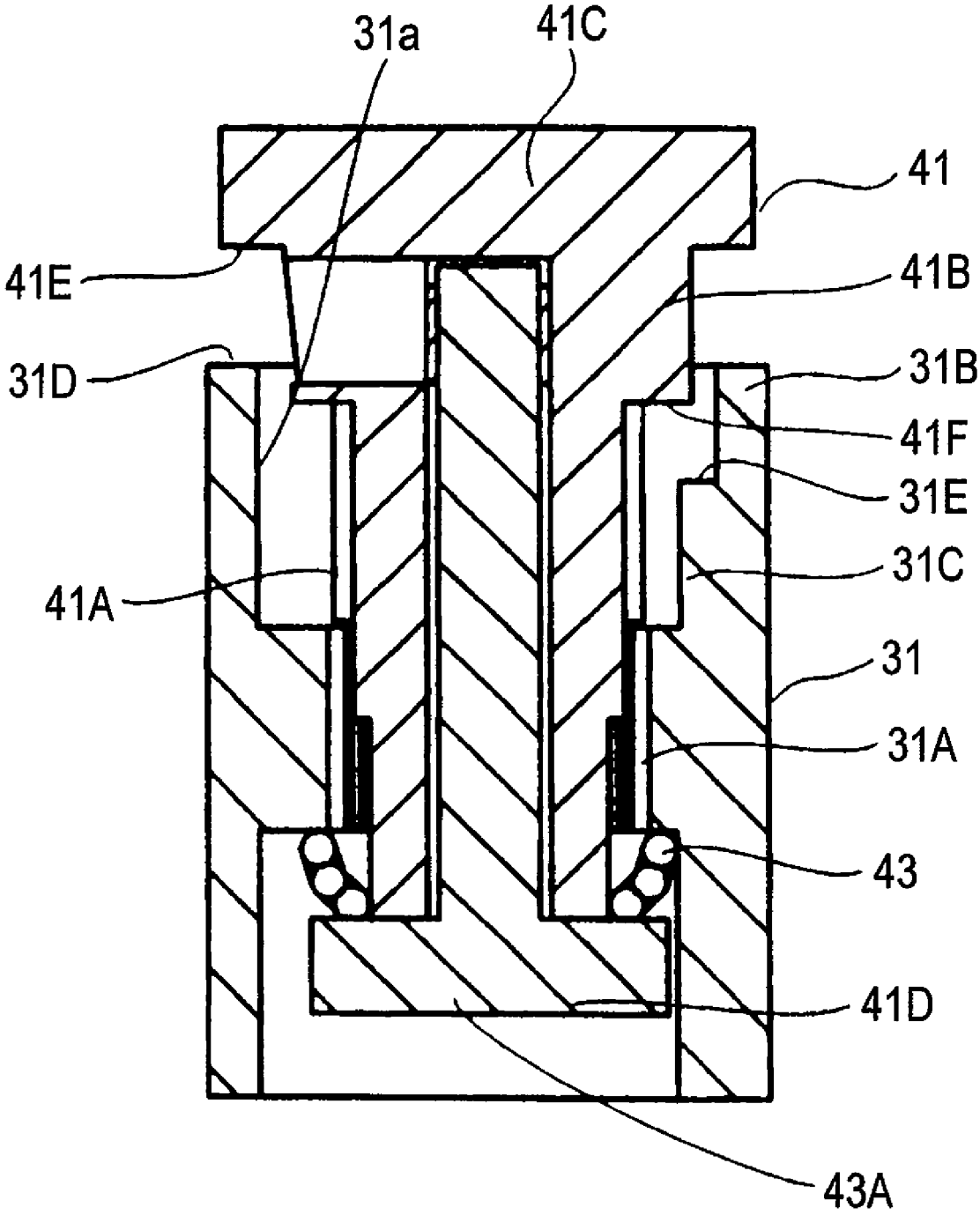
FIG. 6 is a sectional view taken along the line III-III of FIG. 1 (state of pulling the shaft portion)
Figure 7:
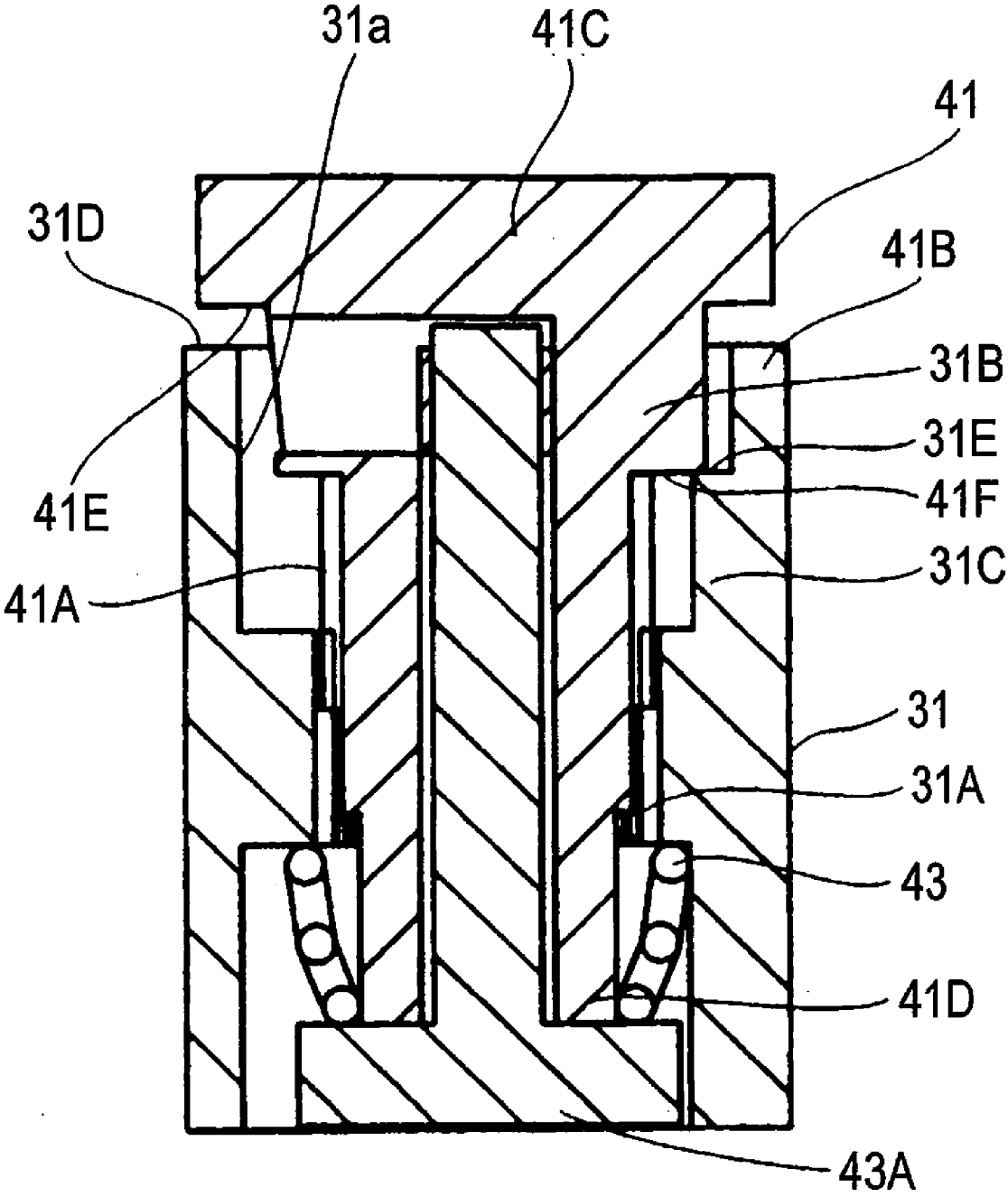
FIG. 7 is a sectional view taken along the line III-III of FIG. 1 (second position state)

In a state in which the shaft portion 41 is disposed at the first position, since a distance between the arm portion 42 and the handle 3 is narrow, the nailing machine 1 cannot be hung from a bolder member, for example, a single pipe or the like by the hook portion 4. In this case, as shown by FIG. 6, in a state in which a user pulls the shaft portion 41 by the hand or the like against the urge force of the coil spring 43 and the inner teeth 31A and the outer teeth 41A are released from being brought in mesh with each other, the arm portion 42 is pivoted to the side of the main body portion 2 such that the arm portion 42 becomes substantially in parallel with the extending direction of the handle 3. When the hand is detached from the state, as shown by FIG. 7, by the urge force of the coil spring 43, the second contact portion 41F is brought into contact with the second position rectifying face 31E and the shaft portion 41 is arranged at the second portion. By arranging the shaft portion 41 at the second position, the distance between the arm portion 42 and the handle 3 can be ensured, and the nailing machine 1 can be hung to a single pipe or the like by the hook portion 4. In the nailing machine 1, the main body portion 2 including a piston, not illustrated, a cylinder, not illustrated, for slidably holding the piston and the like constitute the heaviest object. Therefore, a gravitational center position of the nailing machine 1 is disposed at a vicinity of the main body portion 2. Therefore, by making the main body portion 2 disposed on the lower side of the hook portion 4, the nailing machine 1 can stably be hung.

As shown by FIG. 7, even at the second position, the inner teeth 31A and the outer teeth 41A can be brought in mesh with each other, and therefore, the shaft portion 41 and the arm portion 42 are not unnecessarily pivoted relative to the shaft support portion 31 and a stable hung state can be maintained in the nailing machine 1. Further, the shaft portion 41 is extended in the direction substantially orthogonal to the direction of the output shaft of the main body portion 2 and the direction of extending the handle 3 and the arm portion 42 is provided at the front end in the direction of extending the shaft portion. According to such a constitution, when the nailing machine 1 is hung on a wall or the like by the hook portion 4, the wall and a face rectified from the direction of the output shaft of the nailing machine 1 and the direction of extending the handle 3 are opposed to each other. Therefore, in a state of hanging the nailing machine 1, the nailing machine 1 and the wall are brought into face contact with each other, and therefore, the nailing machine 1 can be hung further stably.

Further, although according to the first embodiment, the constitution of the shaft support portion 31 is constructed by a constitution of inserting the shaft portion 41 from one side into the support hole 31*a*, the invention is not limited thereto but there may be constructed a constriction capable of inserting the shaft portion 41 thereinto, from either of one side and other side. Thereby, the operation can be carried by either hand of the right hand and the left hand.

Figure 8:
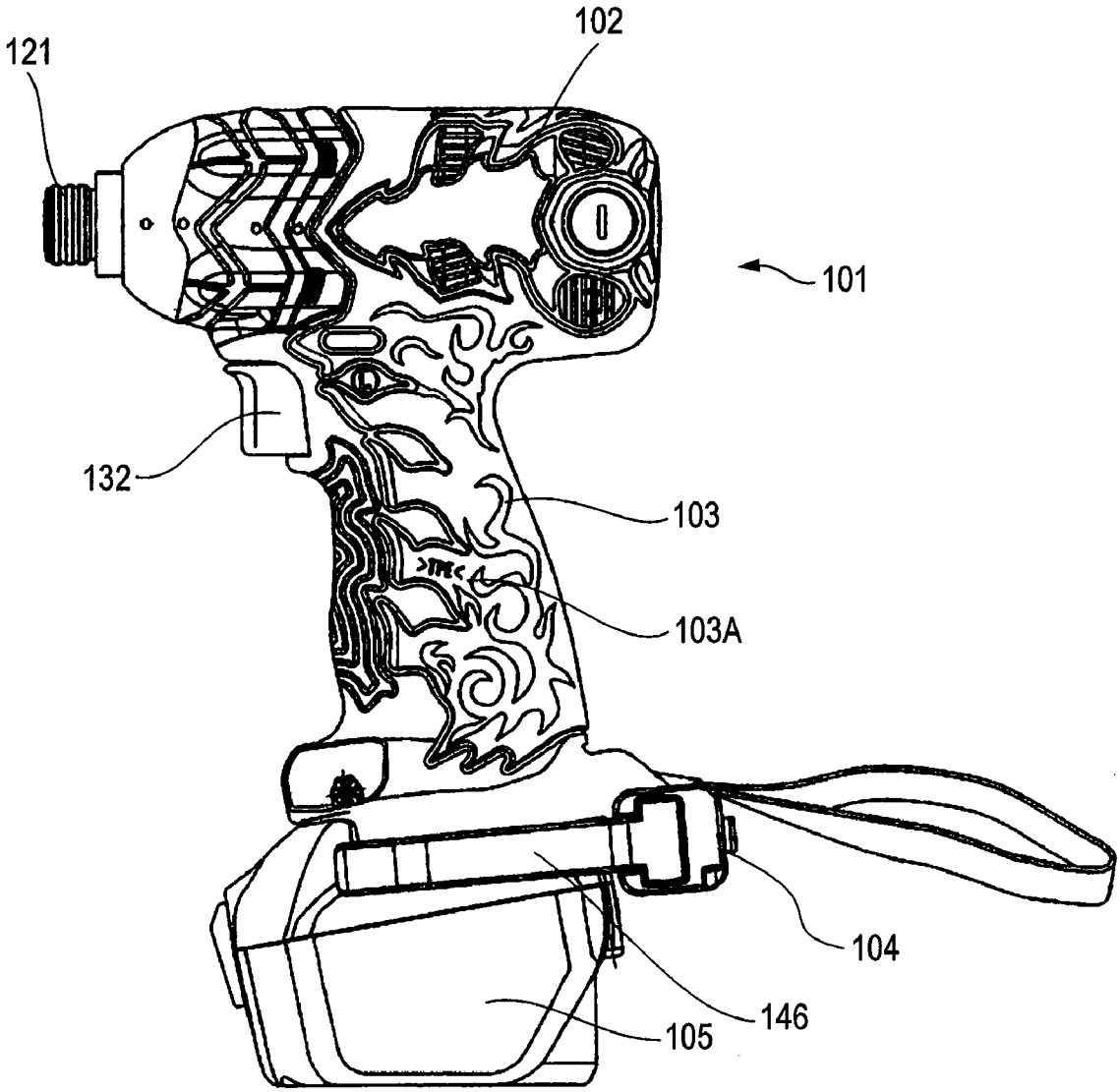
FIG. 8 is a side view of a state of operating a power tool according to a second embodiment of the invention.

Next, a power tool according to a second embodiment of the invention will be explained in reference to FIG. 8 through FIG. 15. As shown by FIG. 8, in the second embodiment, as a power tool, an impact driver 101 constituting power by electricity will be explained.

The impact driver 101 is mainly constituted by a main body portion 102, a handle 103, a hook portion 104, and a battery 105. The main body portion 102 includes a motor, not illustrated, constituting an output portion and a front end portion of the main body portion 102 is provided with a chuck 121 constituting an output shaft portion rotated by being driven by a motor, not illustrated. A rotating shaft of the chuck 121 is in parallel with a direction of the output shaft constituting a direction directed to the chuck 121 of the main body portion 102.

The handle 103 constituting a grabbing portion is extended from a side face portion of the main body portion 102 in a direction of being intersected with the direction of the output shaft. The handle 103 is provided with the battery 105 at a front end of the extension and includes a trigger 132 at a base end of the extension and the motor, not illustrated, is controlled to drive by the trigger 132. Further, a surface of the handle 103 is covered by elastomer 103A constituting a resin material to thereby carry out slip stop working.

Figure 9:
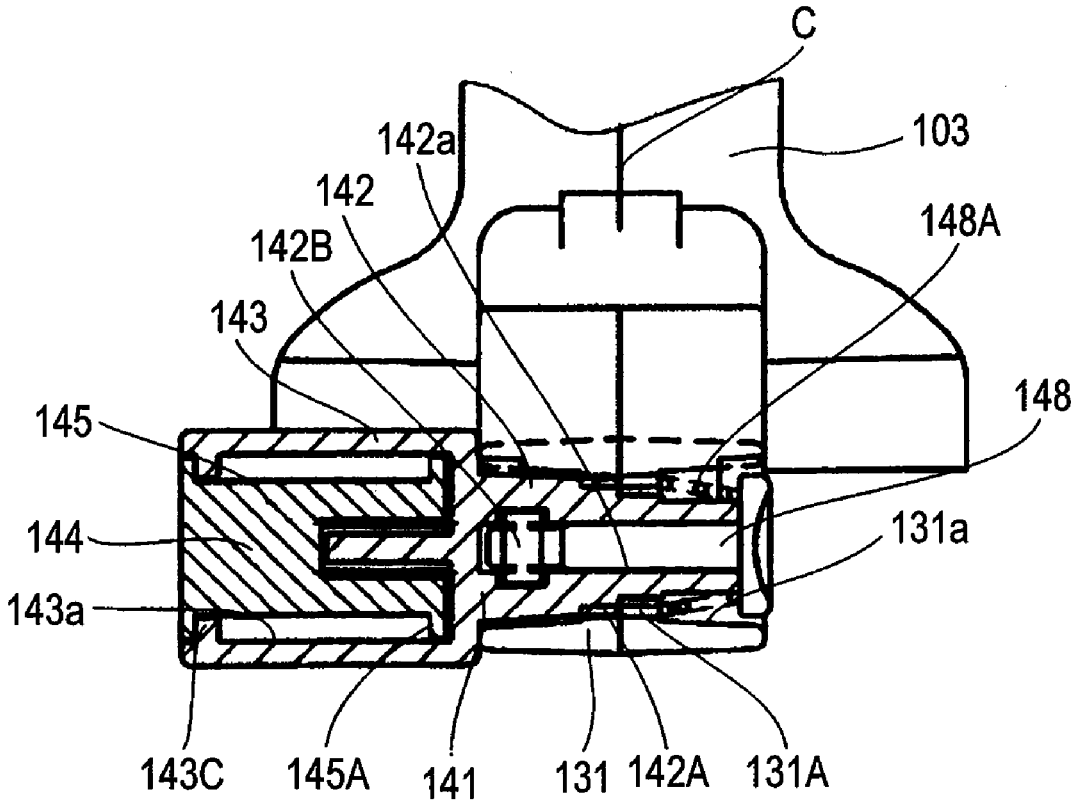
FIG. 9 a sectional view taken along a line IIV-IIV of FIG. 8.
Figure 10:
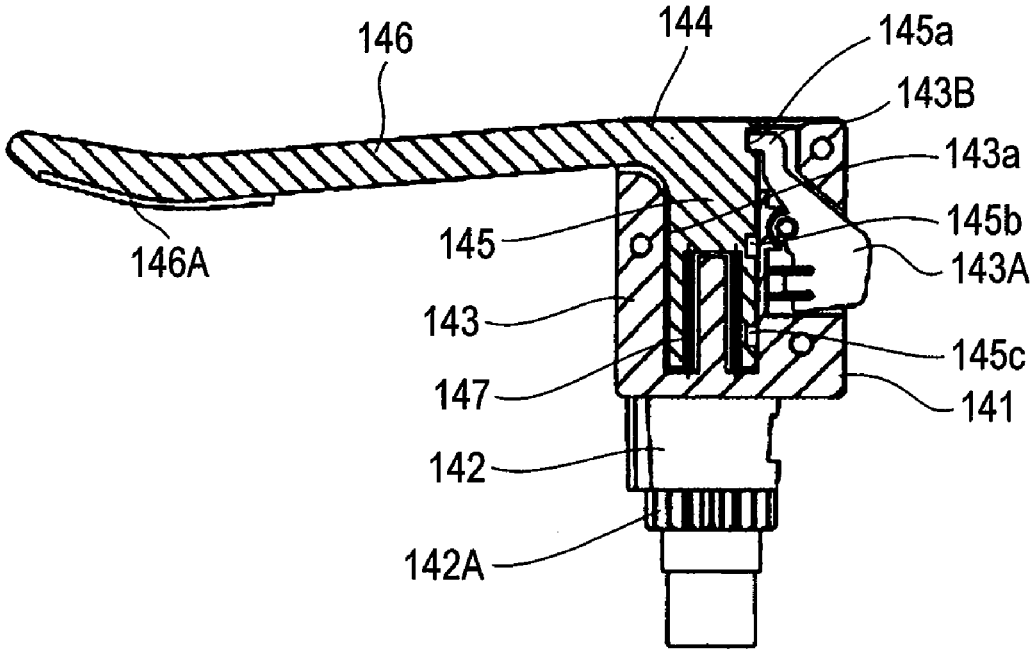
FIG. 10 is a detailed view of a section of a periphery of a shaft portion according to the second embodiment of the invention (state of contracting shaft)

As shown by FIG. 9 and FIG. 10, the hook portion 104 is mainly constituted by a rotation support portion 131 provided at the front end in a direction of extending the handle 103, a shaft support portion 141 supported by the rotation support portion 131, and an arm portion constituting portion 144 provided at an end portion of the shaft support portion 141.

As shown by FIG. 9, the rotation support portion 131 is constituted substantially in a cylindrical shape and formed with a support hole 131*a* at inside thereof. The support hole 131*a* is penetrated in a direction substantially orthogonal to either of the output shaft direction and the extending direction of the handle 103. Further, the rotation support portion 131 is arranged to be disposed substantially at a center of the impact driver 101 in the direction substantially orthogonal to either of the output shaft direction and the extending direction of the handle 103, inner teeth 131A are disposed at a center thereof and a shape thereof is constituted to be symmetrical in the direction.

As shown by FIG. 9, the shaft support portion 141 is mainly constituted by a rotating shaft portion 142 and a receiving portion 133. The rotating shaft portion 142 is constituted substantially in a shape of a circular column and formed with a hole 142*a* bored in an axial direction from one end thereof. A nut 142B is provided at the deepest portion in the boring direction of the hole 142*a* to be able to be screwed with a screw 148 mentioned later.

As shown by FIG. 10, the rotating shaft portion 142 is provided with outer teeth 142A over a total of an outer periphery of substantially a middle portion in the axial direction. The outer teeth 142A is made to be able to be brought in mesh with the inner teeth 131A (FIG. 9). Further, the shaft portion 143 is connected to other end of the rotating shaft portion 142.

The receiving portion 143 is formed with a hole 143*a* from an end portion opposed to a side of the rotating shaft portion 142 to a side of the rotating shaft portion 142, and a shaft portion 145, mentioned later, is made to be able to be inserted into the hole 143*a*. A notch 143A constituting a hanging portion is provided at a wall partitioning the hole 143*a* of the receiving portion 143. The notch 143A is provided with a claw 143B and the claw 143B is projected into the hole 143*a*. An urging member, not illustrated, is interposed between the notch 143A and wall of partitioning the hole 143*a*, and the notch 143A is urged by the urging member and the claw 143B is always projected into the hole 143*a*. Further, when the notch 143A is pressed against the urging member, the claw 143B is made to be able to move from a state of being projected into the hole 143*a* to a state of being pulled back therefrom. A wall face of the receiving portion 143 at a vicinity of an opening of the hole 143*a* and constituting an inner face is provided with a detach stop 143C (FIG. 9) for preventing the shaft portion 145, mentioned later, from being detached from the receiving portion 143.

The arm portion constituting portion 144 is mainly constituted by the shaft portion 145 and an arm portion 146. The shaft portion 145 is constituted by substantially a shape of a circular column which is inserted into the hole 143*a* and is slidable and includes the arm portion 146 at one end portion constituting a rear end in a direction of being inserted into the hole 143*a*. Further, a side face of the shaft portion 145 is respectively formed with three pieces of a first groove 145*a*, a second groove 145*b*, and a third groove 145*c* constituting hung portions uniformly arranged from one end portion side to other end portion side. The three grooves are formed in a direction substantially orthogonal to a direction of sliding the shaft portion 145 and respectively made to be able to be engaged with the claw 143B. Further, other end of the shaft portion 145 is provided with a projected portion 145A projected from a side face thereof to an outer side in a diameter direction. The projected portion 145A is constituted to be able to be brought into contact with the detach stop 143C when the shaft portion 145 is slid at inside of the hole 143*a*.

The arm portion 146 is molded integrally with the shaft portion 145 from a resin of an elastic material or the like and is extended substantially orthogonal to the direction of sliding the shaft portion 145. A front end of the arm portion 146 constitutes a shape of being bowed back by constituting a barrel by a side of the shaft portion 145. Further, the bowed-back barrel portion of the arm portion 146 is provided with elastomer 146A of a resin material. Therefore, when the arm portion 146 is arranged on the handle 103, a member on which the impact driver 101 is hung can elastically be squeezed by members subjected to slip stop by the elastomer 103A of the handle 103 and the elastomer 146A.

In a state of inserting the shaft portion 145 into the hole 143*a*, a spring 147 is interposed between the shaft portion 145 and the receiving portion 143 to urge the shaft portion 145 in a direction of being extruded from the hole 143*a*.

In a state of inserting the rotating shaft portion 142 into the support hole 131*a* of the rotation support portion 131 from one side, the screw 148 is inserted from other side of the support hole 131*a* to be screwed with the nut 142B. In a state of screwing the screw 148, a coil spring 148A is arranged between a flange portion of the screw 148 and a side of the inner teeth 131A of the rotation support portion 131. Therefore, the screw 148 is urged in an axial direction of the rotating shaft portion 142 to be discharged from an opening on other side of the support hole 131*a* by the coil spring 148A.

The screw 148 is screwed with the nut 142B at inside of the rotating shaft portion 142, and therefore, an urge force thereof is operated to the rotating shaft portion 142 and the rotating shaft portion 142 is urged in a direction of being directed from one side to other side, that is, an inserting direction. Therefore, the inner teeth 131A and the outer teeth 142A are brought into a state of being always brought in mesh with each other so far as an external force is not exerted such that the rotating shaft portion 142 is pulled in a direction of being extended out constituting a direction opposed to the inserting direction.

When an operation is carried out by the impact driver 101 having the above-described constitution, as shown by FIG. 8, the arm portion 146 is arranged to be substantially in parallel with the axial direction of the main body portion 102 and the claw 143B is hung to the first groove 145*a*. Thereby, the arm portion 146 is arranged substantially at a vicinity of the surface of the handle 103 to be restrained from constituting a hindrance of the operation.

Figure 11:
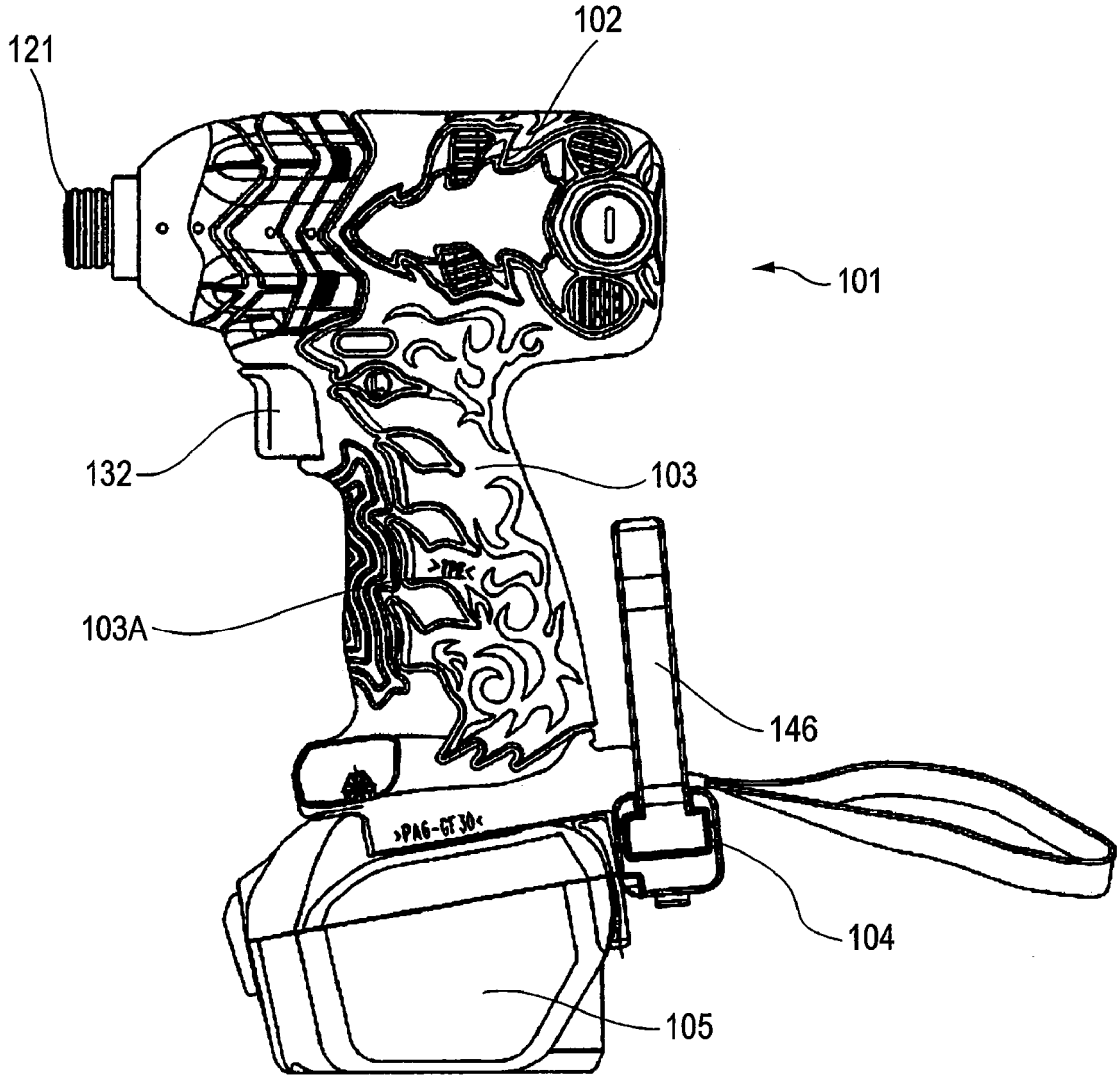
FIG. 11 is a detailed view of the section of the periphery of the shaft portion according to the second embodiment of the invention (state of elongating shaft)
Figure 12:
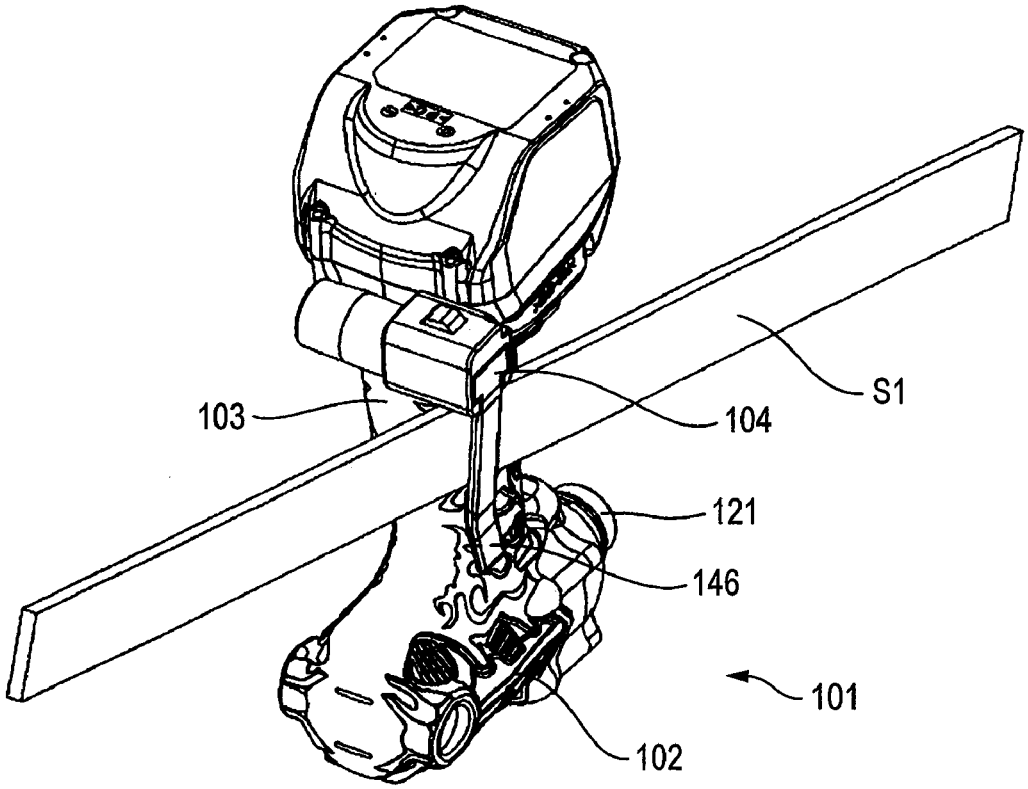
FIG. 12 is a detailed view of the section of the periphery of the shaft portion according to the second embodiment of the invention (state of elongating shaft the most)

When the operation is interrupted and the impact driver 101 is hung from a thin member of a belt or the like, the outer teeth 142A and the inner teeth 131A are released from being brought in mesh with each other by pulling the shaft support portion 141 and the front end of the arm portion 146 is pivoted to be directed to the side of the main body portion 102 as shown by FIG. 11. Under the state, as shown by FIG. 12, the impact driver 101 is hung from the belt S1. In the impact driver 101, the main body portion 102 includes a motor, not illustrated, a transmission mechanism, not illustrated, for transmitting a drive force to the motor to the chuck 121 and the like, and therefore, the impact driver 101 is heavy, and therefore, the gravitational center position of the impact driver 101 is disposed at a vicinity of the main body portion 102. Therefore, by making the main body portion 102 disposed on the lower side of the hook portion 104, the impact driver 101 can be hung therefrom stably.

Figure 13:
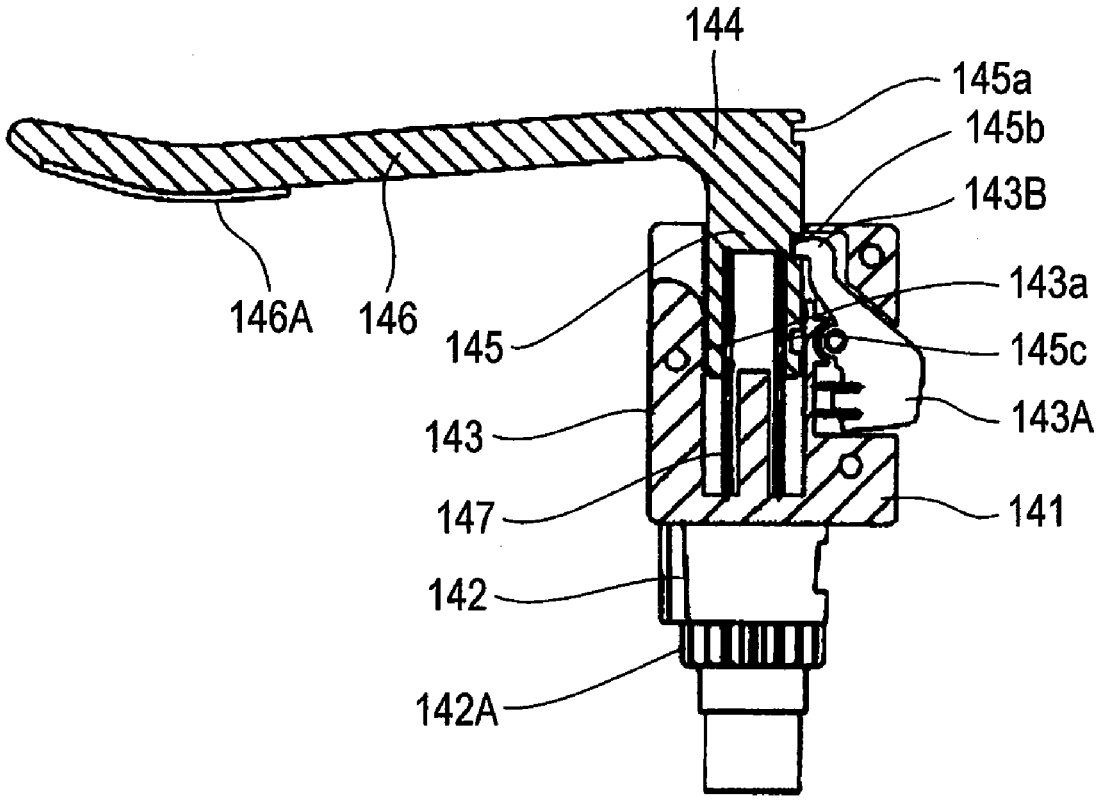
FIG. 13 is a side view of a state of hanging the power tool according to the second embodiment of the invention.
Figure 14:
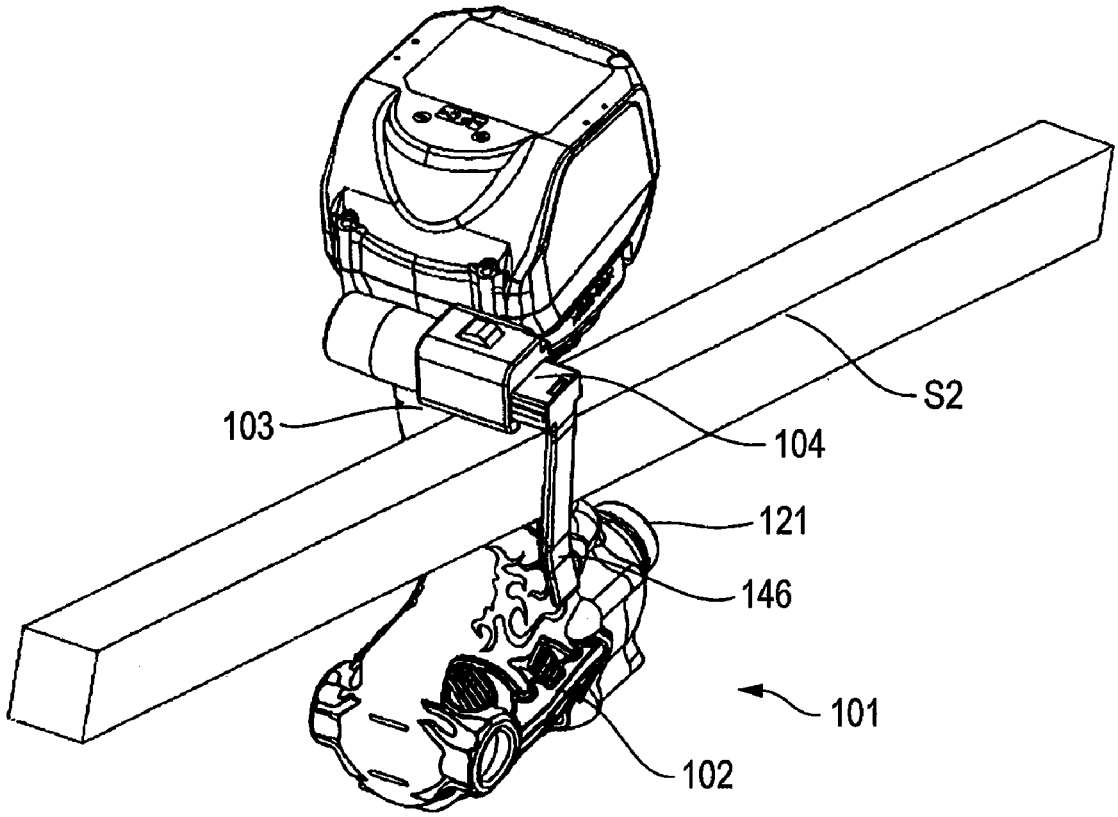
FIG. 14 is a perspective view of a state of hanging the power tool according to the second embodiment of the invention from a belt.

Further, when the impact driver 101 is hung from a square member or the like, in order to separate the arm portion 146 and the handle 103, the claw 143B is released from the first groove 145*a* by pressing the notch 143A, the shaft portion 145 is moved by the urge force of the spring 147 and as shown by FIG. 13, the claw 143B is hung from the second groove 145*b*. Thereby, as shown by FIG. 14, the impact driver 101 can preferably be hung even from a square member S2 having a width by the hook portion 104. Further, portions of the hook portion 104 and the handle 103 brought into contact with the square member S2 are arranged with the elastomer 146A (FIG. 8) and the elastomer 103A (FIG. 13). Therefore, even when the square member S2 is a member arranged skewedly of, for example, a handrail of a staircase or the like, the impact driver 101 is restrained from being slid on the square member S2 by generating a friction force between the square member S2 and the elastomer 146A and the elastomer 103A, and the impact driver 101 can preferably be hung from the square member S2. Further, the arm portion is constituted by an elastic material, and therefore, even when a width of the square member S2 is larger than a distance between the arm portion 146 and the handle 103, the square member S2 can be pinched thereby so far as the width is a width to some degree.

Figure 15:
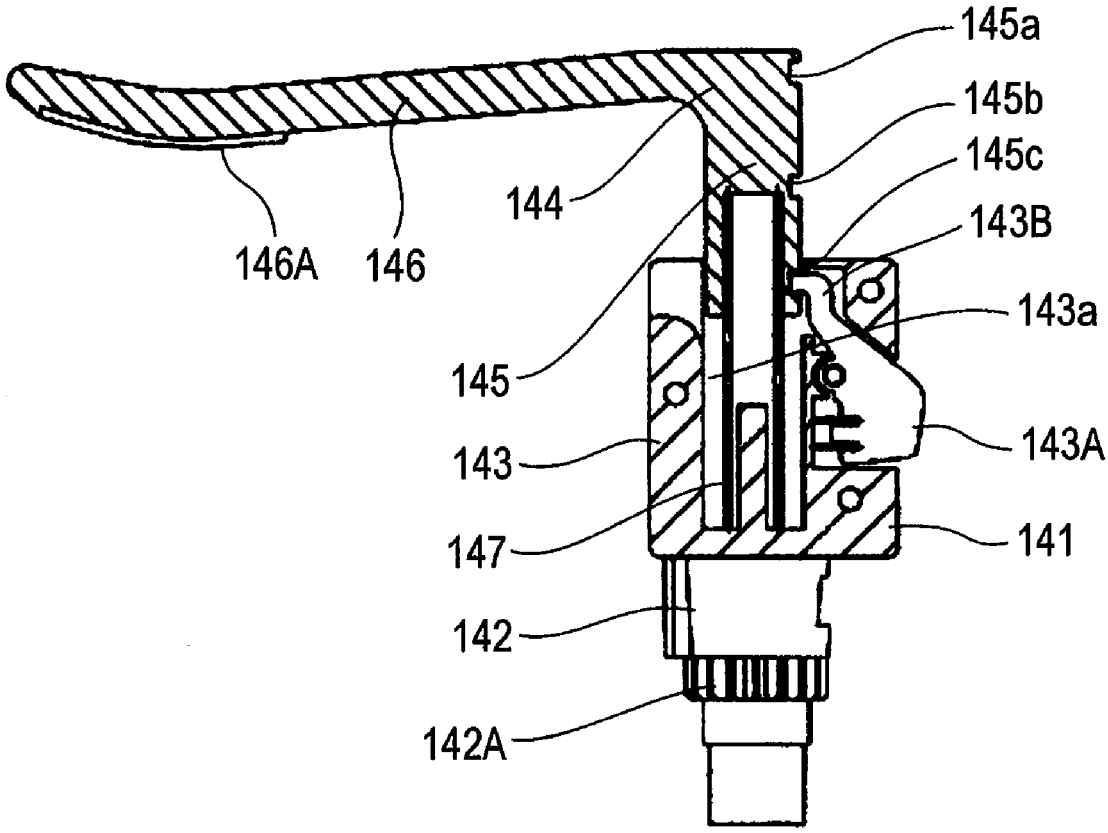
FIG. 15 is a perspective view of a state of hanging the power tool according to the second embodiment of the invention from a square member.
Figure 16:
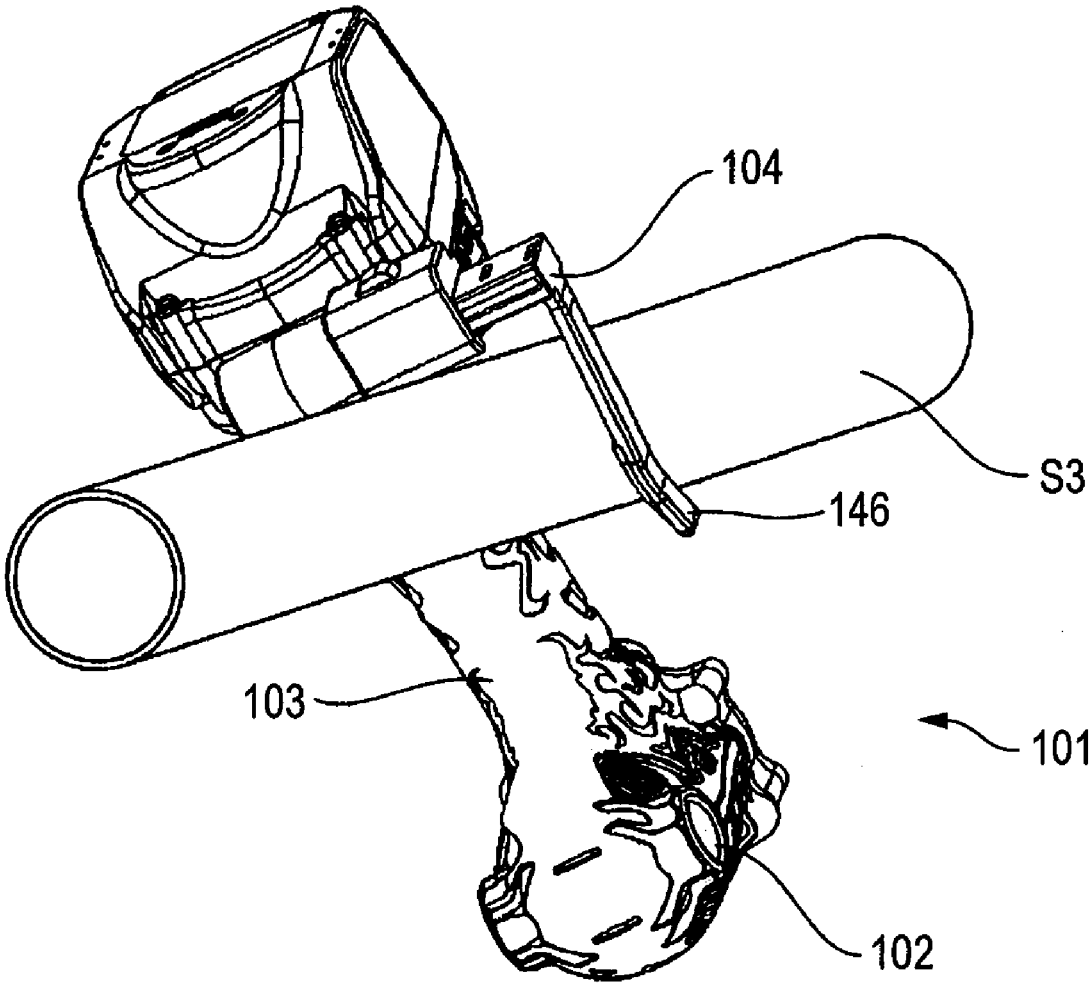
FIG. 16 is a perspective view of a state of hanging the power tool according to the second embodiment of the invention from a single pipe.

Further, when the impact driver 101 is hung from a single pipe or the like, in order to further separate the arm portion 146 and the handle 103, the claw 143B is released from the second groove 145*b* by pressing the notch 143A and is hung from the third groove 145*c* as shown by FIG. 15. Thereby, the distance between the arm portion 146 and the handle 103 is maximally enlarged and as shown by FIG. 16, even a member having a wide width such as a single pipe S3 can preferably be pinched thereby. The single pipe S3 is provided with a section in a circular shape, and therefore, when the impact driver 101 is hung therefrom, there is a case in which the single pipe S3 is pivoted in a peripheral direction. However, portions of the impact driver 101 brought into contact with the single pipe S3 are arranged with the elastomer 146A and the elastomer 103A, and therefore, a large friction force is generated and the impact driver 101 can be restrained from being pivoted in the peripheral direction of the single pipe S3.

Further, even when the notch 143A is excessively pressed and the claw 143B is not hung from the third groove 145*c* and urged by the spring 147, the projected portion 145A is brought into contact with the detach stop 143C to prevent the shaft portion 145 from being detached from the hole 143*a*.

Further, although in the power tool of the second embodiment, the arm portion 146 is constituted by a resin or the like, the invention is not limited thereto but the arm portion 146 may be constituted by a metal member so far as the arm portion 146 is constituted by an elastic material.

Figure 17:
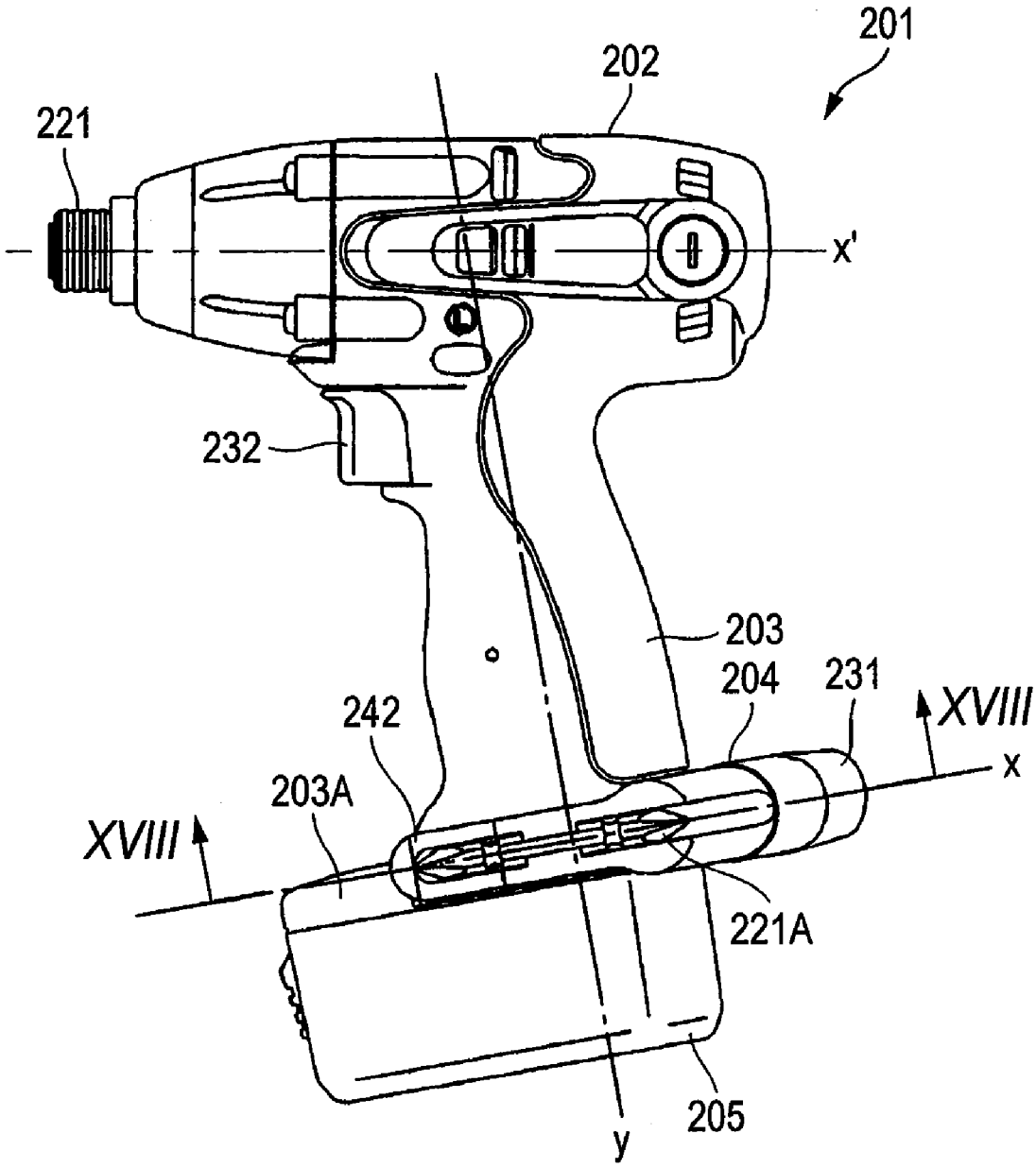
FIG. 17 is a side view showing a power tool according to a third embodiment of the invention.

Next, a power tool according to a third embodiment will be explained in reference FIG. 17 through FIG. 21. As shown by FIG. 17, according to the third embodiment, as a power tool, an electric driver 201 will be explained.

The electric driver 201 is mainly constituted by a main body portion 202, a handle 203, a hook portion 204, and a battery 205. The main body portion 202 includes a motor, not illustrated, constituting an output portion, and a front end portion of the main body portion 202 is provided with a chuck 221 constituting an output shaft portion driven by the motor, not illustrated. Further, the main body portion 202 is rectified with an output axis center x' passing an output shaft of the motor, not illustrated, and the chuck 221 by passing a front end side through a rear end side.

The handle 203 constituting a grabbing portion is extended from a side face portion of the main body portion 202 in a direction of being intersected with the output axis center x' and a front end of the extending direction is provided with the battery 205. The handle 203 is provided with a switch 232 at a base end portion of the extension and the motor, not illustrated, is controlled to drive by the switch 232. Further, a shaft support portion 231 is provided at a front end in a direction of extending the handle 203. Further, the handle 203 is rectified with a grabbing portion axis center y extended in the extending direction and the grabbing portion axis center y is intersected with the output axis center x'. A first imaginary plane x' y substantially in parallel with the side face of the electric driver 201 is rectified by the output axis center x' and the grabbing portion axis center y.

The first imaginary plane x' y includes an intersection line x orthogonal to the grabbing portion axis center y and passing the shaft support portion 231. A normal line z of the first imaginary plane x' y is extended from an intersection point of the intersection line x and the grabbing portion axis center y, and a second imaginary plane yz orthogonal to the first imaginary plane x' y is rectified from the grabbing portion axis center y and the normal line z.

Further, the switch 232 is disposed on one side of arranging the chuck 221 with regard to the second imaginary plane yz and the shaft support portion 231 is disposed on other side of the side opposed to the chuck 221 with regard to the second imaginary plane yz.

Figure 18:
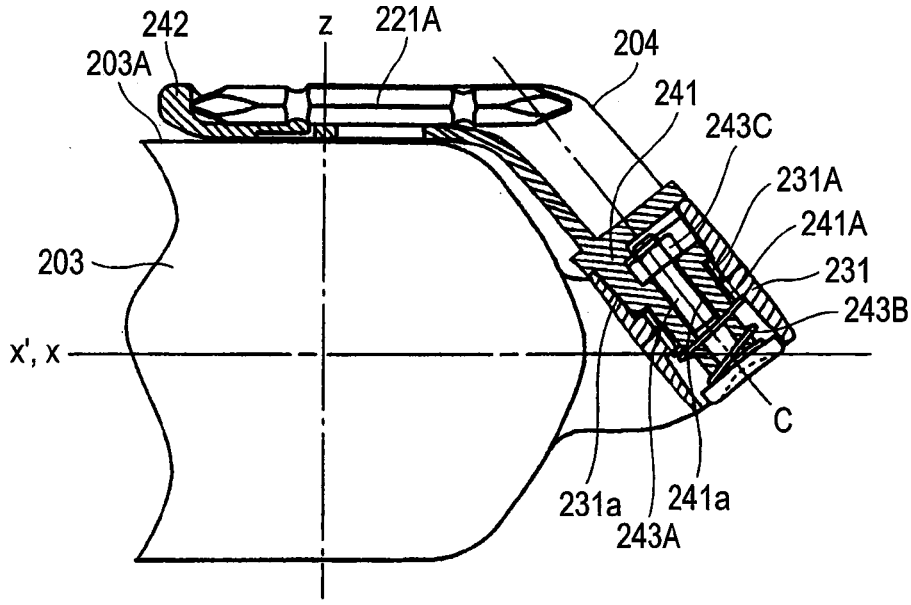
FIG. 18 is a partial bottom view showing a state of bringing a shaft portion at a periphery of a hook portion and a shaft support portion in mesh with each other in the power tool according to the third embodiment of the invention.

The shaft support portion 231 is constituted substantially by a cylindrical shape and as shown by FIG. 18, inside thereof is formed with a support hole 231*a*. The support hole 231*a* is formed such that an axis center C of a shaft portion 241, mentioned later, is extended to be skewedly intersected with the first imaginary plane x' y, a front end position and a base end position of the shaft portion 241 are disposed substantially at the same position in the grabbing portion axis center y direction and a front end position in a direction of inserting the shaft portion 241 is separated from the second imaginary plane yz more than a rear end position in the inserting direction. Further, inner teeth 231A are provided at an inner face of the support hole 231*a* and an inner face of a substantially center portion in a penetrating direction over an entire periphery thereof.

The hook portion 204 is mainly constituted by the shaft portion 241 and an arm portion 242. The shaft portion 241 is constituted substantially by a cylindrical shape and outer teeth 241A are provided over an entire periphery of an outer periphery of a front end portion thereof. The shaft portion 241 is inserted into the support hole 231*a* to be supported by the shaft support portion 231 such that the outer teeth 241A and the inner teeth 231A are brought in mesh with each other.

The shaft portion 241 is formed with a through hole 241*a* penetrated in a direction the same as that of the support hole 231*a* substantially at a center thereof. A screw 243A is inserted into the through hole 241*a* such that a flange portion thereof is disposed on a front end side in the direction of inserting the shaft portion 241 to be screwed with a nut 243C to be fixed thereby. A spring 243B is interposed between the flange portion of the screw 243A and a position at a vicinity of the inner teeth 231A at inside of the support hole 231*a*. Therefore, the shaft portion 241 is brought into a state of being urged in the inserting direction by the spring 243*b* by way of the screw 243A, and the inner teeth 231A and the outer teeth 241A are brought in mesh with each other to restrain the shaft portion 241 from being pivoted relative to the shaft support portion 231 so far as a reaction force is not exerted against the urge force.

As shown by FIG. 17 and FIG. 18, the arm portion 242 is connected to a front end position in the direction of extending the shaft portion 241 from the shaft support portion 231 (rear end position in the direction of inserting the shaft portion 241), substantially in parallel with the intersection line x and extended from the shaft portion 241 to the side of the second imaginary plane yz. As shown by FIG. 18, a position of a front end side of the arm portion 242 is substantially brought into contact with an end portion surface 203A of the handle 203. A state in which the arm portion 242 is substantially in parallel with the intersection line x in the hook portion 204 is defined as a containing position. Further, a driver bit 221A mounted to the chuck 221 is held at the arm portion 242.

Figure 19:
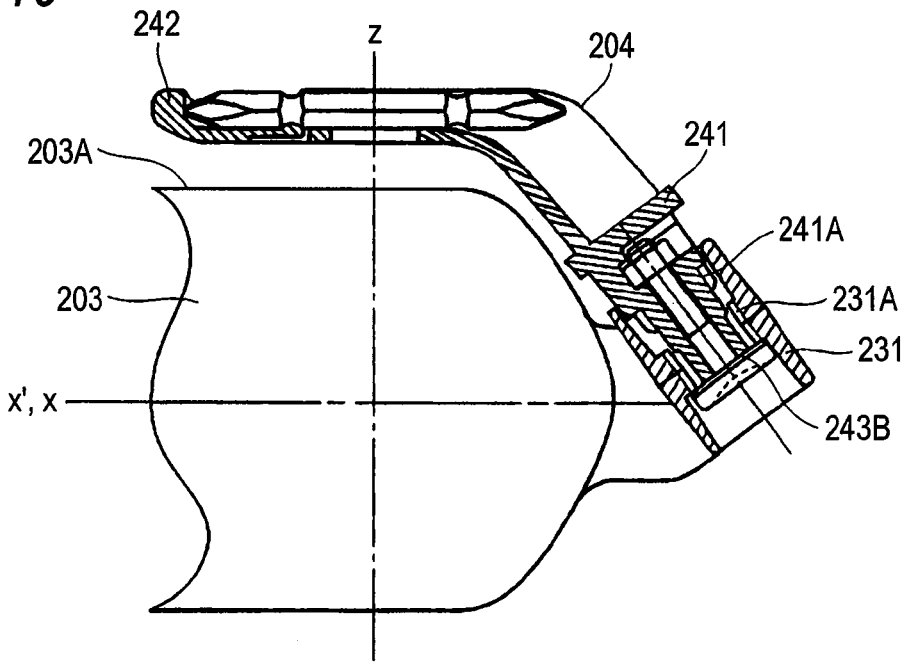
FIG. 19 is a partial bottom view showing a state of releasing the shaft portion at the periphery of the hook portion and the shaft support portion from being brought in mesh with each other in the power tool according to the third embodiment of the invention.

According to the electric driver 201 having the above-described constitution, when a user hangs the electric driver 201 from a single pipe or the like, when the electric driver 201 is not used, as shown by FIG. 19, the shaft portion 241 is pulled in the extending direction constituting a direction opposed to the urge force of the spring 243B to release the inner teeth 231A and the outer teeth 241A from being brought in mesh with each other.

Figure 20:
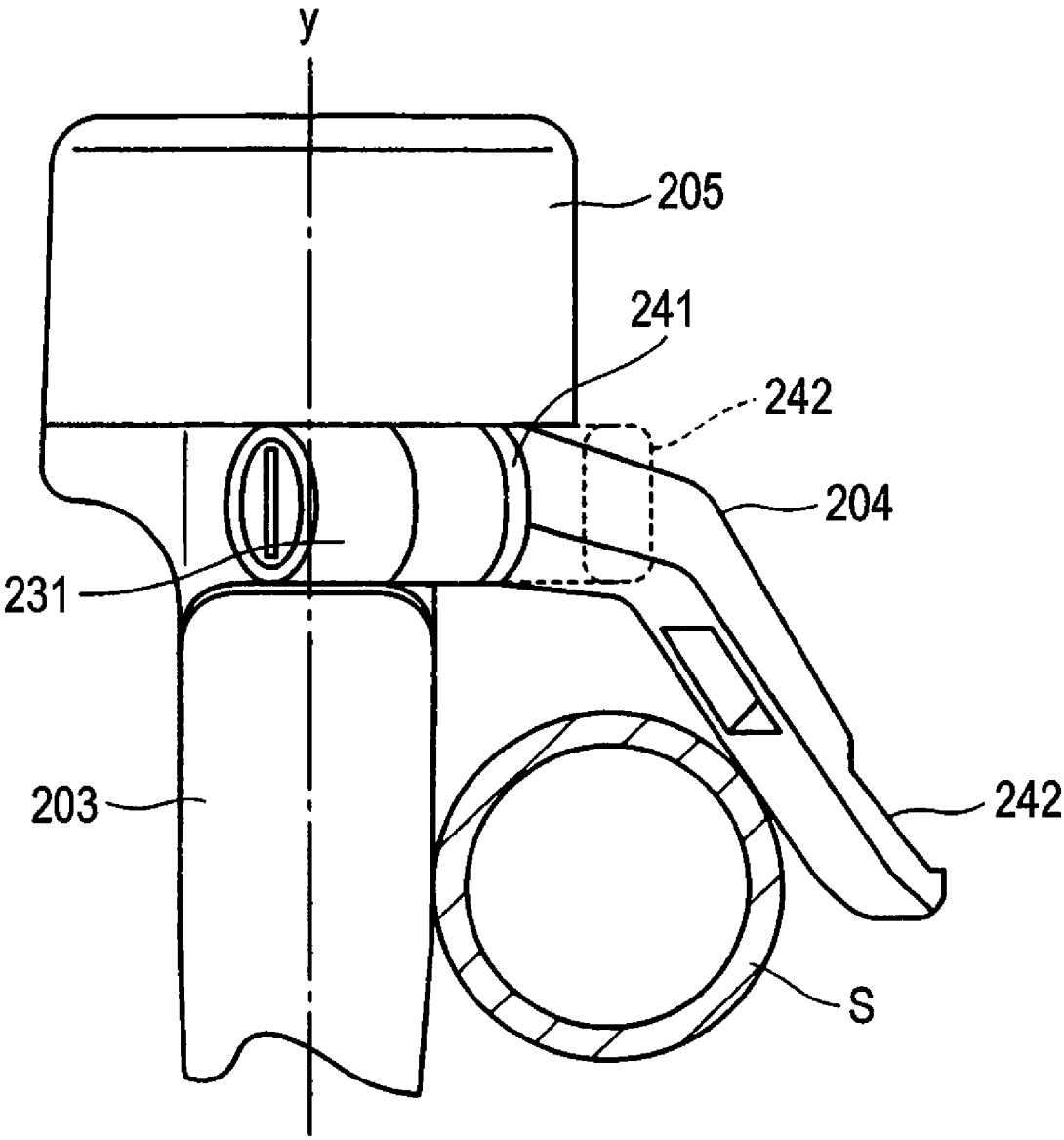
FIG. 20 is a back view showing a state of moving an arm portion to a hanging position in the power tool according to the third embodiment of the invention.

Further, as shown by FIG. 20, the arm portion 242 is pivoted by an arbitrary angle to a side of the main body portion 202 (FIG. 17) and is moved to a hanging position capable of hanging from the single pipe S. As shown by FIG. 18, at the hook portion 204, the shaft portion 241 is axially supported by the shaft support portion 231 in a state of being skewedly intersected with the first imaginary plane x' y substantially in parallel with the side face of the electric driver 201, and therefore, in a state of FIG. 20, a locus of pivoting the arm portion 242 is not in parallel with the first imaginary plane x' y but is brought into a state of being inclined thereto. Further, the shaft portion 241 is inclined to the side of the second imaginary plane yz and the arm portion 242 is extended substantially in parallel with the intersection line x and to the side of the second imaginary plane yz at the containing position. Therefore, the arm portion 242 is proximate to the first imaginary plane x' y the most in the locus of pivoting thereof and the arm portion 242 is remote from the first imaginary plane x' y by being pivoted from the position. Therefore, by moving the arm portion 242 from the containing position to the hanging position, a distance between the arm portion 242 and the surface of the handle 203 is prolonged and the electric driver 201 can be hung to insert the single pipe S therebetween.

Further, fixing of the shaft portion 241 to the shaft support portion 231 is achieved by bringing the inner teeth 231A and the outer teeth 241A in mesh with each other, and therefore, the hanging position can be constituted by an arbitrary angle capable of bringing the inner teeth 231A and the outer teeth 241A in mesh with each other. Therefore, when the electric driver 201 is hung from a hung member having a wide width of a single pipe or the like, a distance between the arm portion 242 and the handle 203 can be increased by increasing an angle of pivoting the arm portion 242 and when the electric driver 201 is hung from a hung member having a narrow width of a belt of a user or the like, the distance between the arm portion 242 and the handle 203 can be reduced by reducing the angle of pivoting the arm portion 242.

Figure 21:
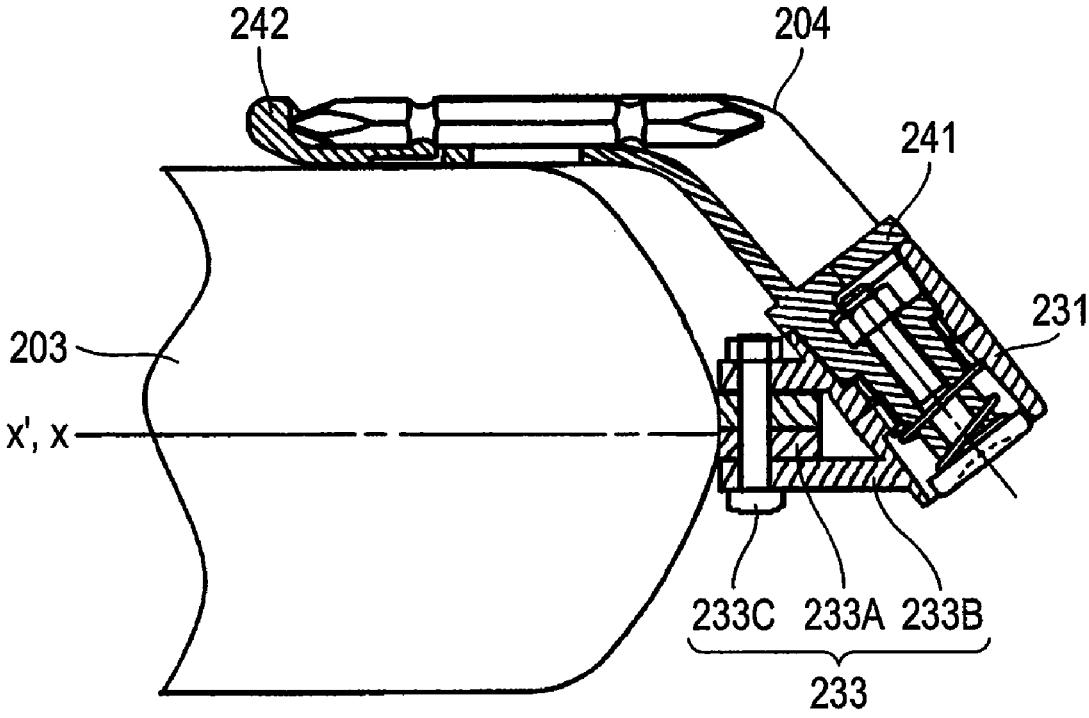
FIG. 21 is a partial bottom view showing a state of the periphery of the hook portion in a modified example of the power tool according to the third embodiment of the invention.

As a modified example of the power tool according to the third embodiment, as shown by FIG. 21, a connecting portion 233 may be provided between the handle 203 and the shaft support portion 231. The connecting portion 233 is constituted by a base portion 233A on the side of the handle 203, a holding portion 233B on the side of the shaft support portion 231, and a screw 233C for connecting the base portion 233A and the holding portion 233B. The base portion 233A is extended from a position of including the first imaginary plane x' y of the handle 203 and the holding portion 233B is constituted by a pair of arms provided at the shaft support portion 231 and capable of squeezing the base portion 233A.

According to the constitution, by bonding the holding portion 233B to the base portion 233A respectively from one side and from other side of the first imaginary plane x' y, the arm portion 242 can selectively be arranged to sides of respective faces of one side and other side of the first imaginary plane x' y. Therefore, even when a user holds to use the electric driver 201 by either of the right hand and the left hand, by switching the connection of the connecting portion 233, a way of use of the hook portion 204 can be ensured.

Next, a power tool according to a fourth embodiment of the invention will be explained in reference to FIG. 22 and FIG. 23. An electric driver 301 constituting a power tool according to the fourth embodiment shown in FIG. 22 is substantially the same as the electric driver 201 according to the third embodiment except a position of attaching a shaft support portion 331, and therefore, an explanation of the constitution will be omitted by adding 100 to notations of the electric driver 201 according to the third embodiment.

Figure 22:
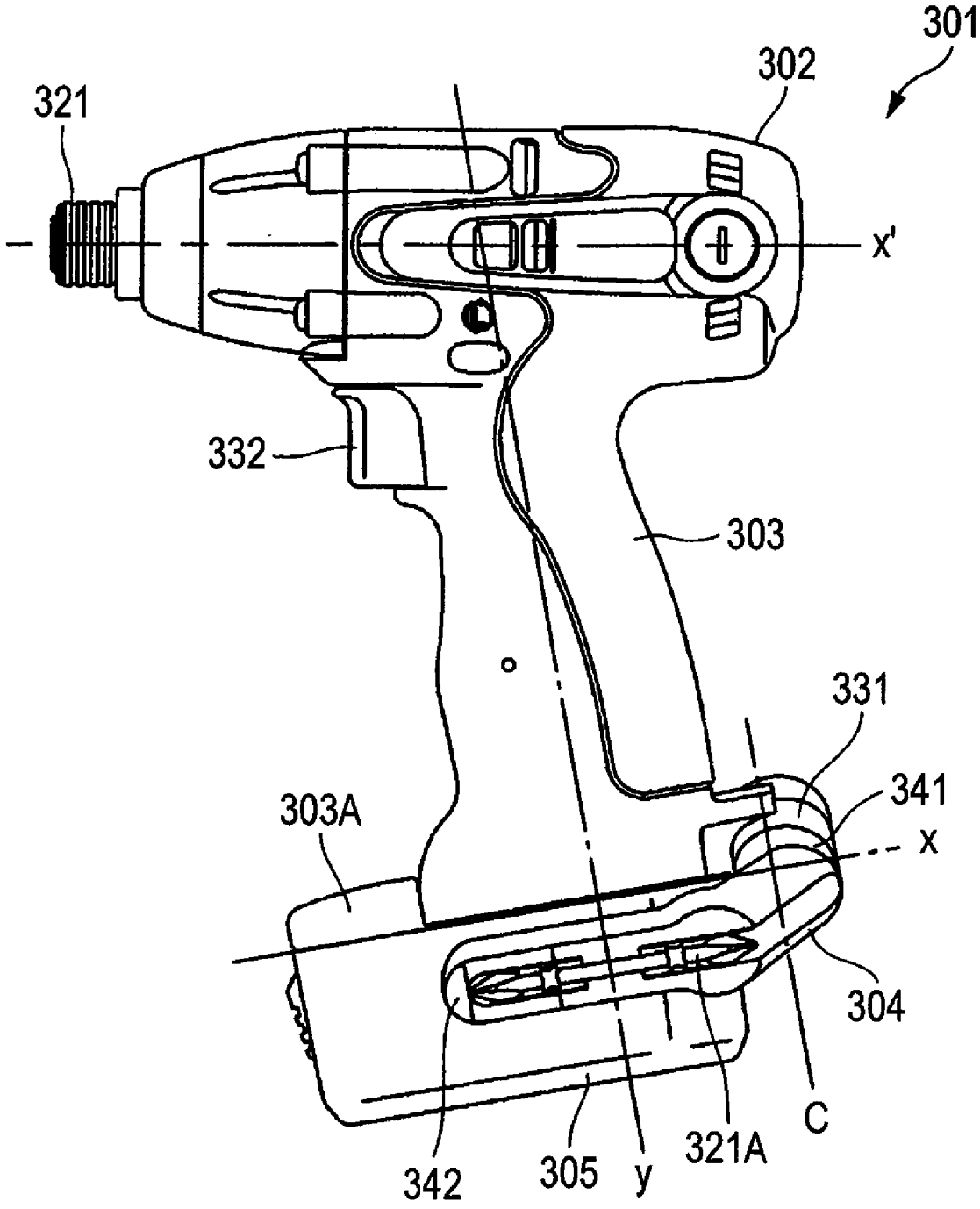
FIG. 22 is a side view showing a power tool according to a fourth embodiment of the invention.
Figure 23:
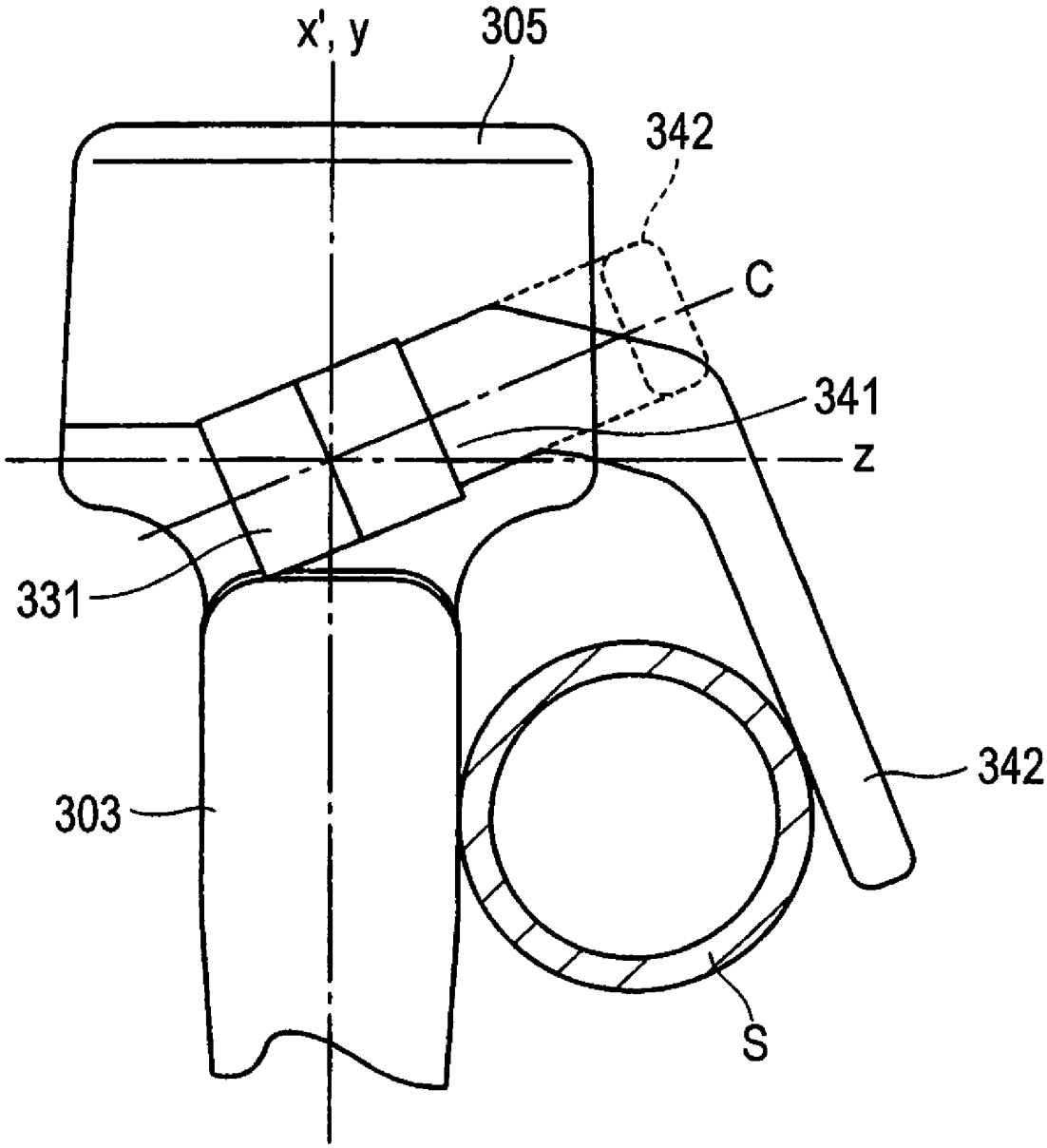
FIG. 23 is a back view showing a state of moving an arm portion to a hanging position in the power tool according to the fourth embodiment of the invention.

As shown by FIG. 22 and FIG. 23, the shaft support portion 331 is constituted such that an axis center C of a shaft portion 341 is extended to be skewedly intersected with the first imaginary plane x' y, a front end position in a direction of inserting a shaft portion 341 is arranged at a position more proximate to a main body portion 302 than a rear end position in the inserting direction on the grabbing portion axis center y and the axis center C of the shaft portion 341 is substantially in parallel with the yz plane including the grabbing portion axis center y.

Similar to the third embodiment, the shaft portion 341 is axially supported by the shaft support portion 331 in a state of being skewedly intersected with the first imaginary plane x' y, and therefore, a locus of pivoting the arm portion 342 is not in parallel with the first imaginary plane x' y but is brought into an inclined state. Therefore, the arm portion 342 is brought into a state of being proximate to the first imaginary plane x' y the most in a state of being extended in a direction of being remote from the main body portion 302 along the grabbing portion axis center y. By being pivoted such that the front end of the arm portion 342 becomes proximate to the main body portion 302 from the proximate state, the arm portion is separated from the side face of the electric driver 301 substantially in parallel with the first imaginary plane x' y.

As shown by FIG. 22, the arm portion 342 is extended to a side of the second imaginary plane yz substantially in parallel with the intersection line x and from the shaft portion 341 at the containing position, substantially proximate to a surface of a handle 303 and a front end portion of the arm portion 342 is pivoted from the position to a hanging position. The hanging position is more proximate to the main body portion 302 than the containing position, and therefore, by pivoting the arm portion 342 to the hanging position, the arm portion 342 is separated from the surface of the handle 303 to expand an interval therebetween, as shown by FIG. 23, the electric driver 301 can be hung from the single pipe S to insert the single pipe S between the handle 303 and the arm portion 342.

Figure 24:
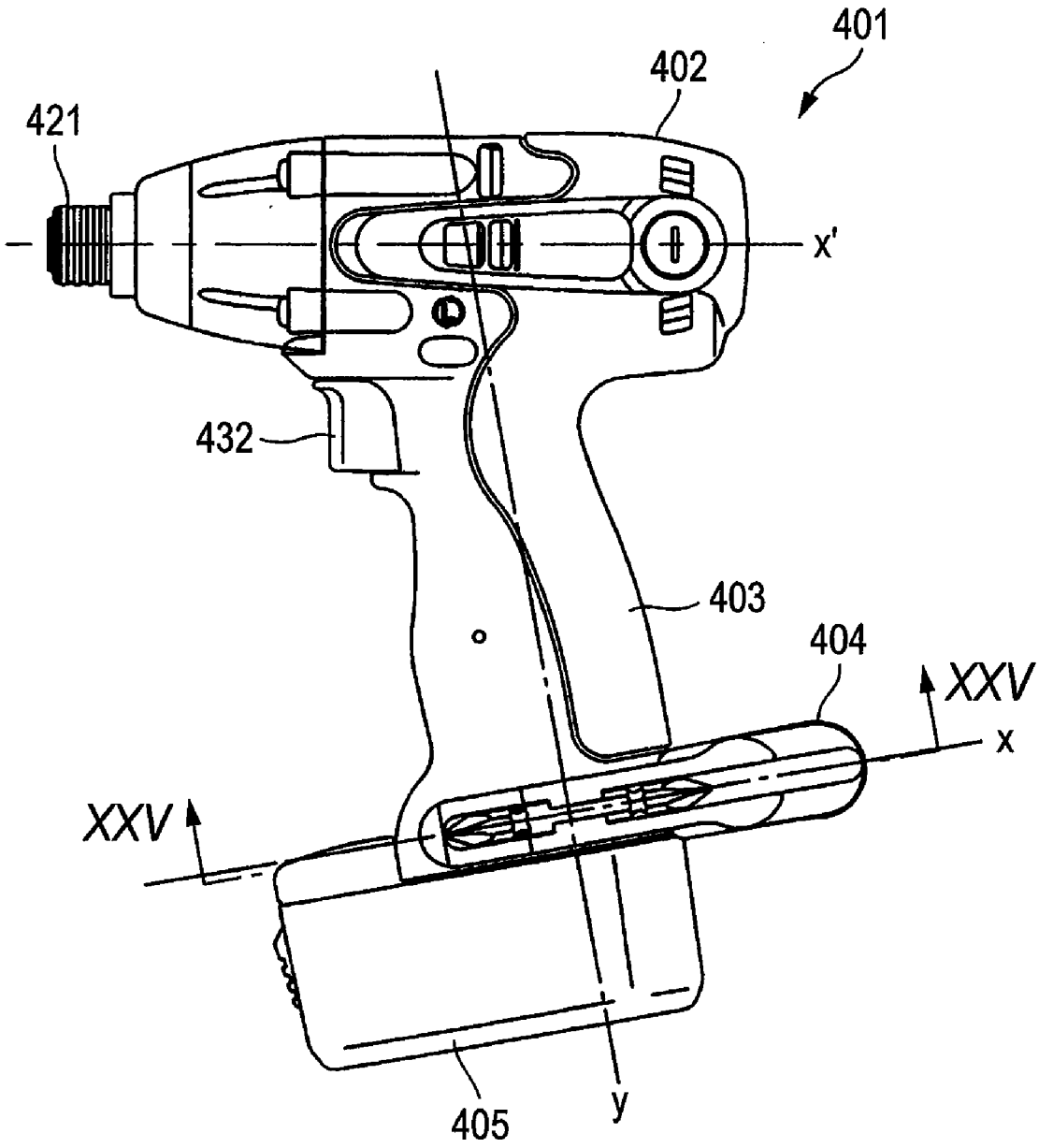
FIG. 24 is a side view showing a power tool according to a fifth embodiment of the invention.

Next, a power tool according to a fifth embodiment of the invention will be explained in reference to FIG. 24 through FIG. 29. An electric driver 401 constituting a power tool according to the fifth embodiment shown in FIG. 24 is substantially the same as the electric driver 201 according to the third embodiment except a constitution related to connection of a shaft support portion 431 and a handle 403, and therefore, an explanation of the constitution will be omitted by adding 200 to notations of the electric driver 201 according to the third embodiment.

Figure 25:
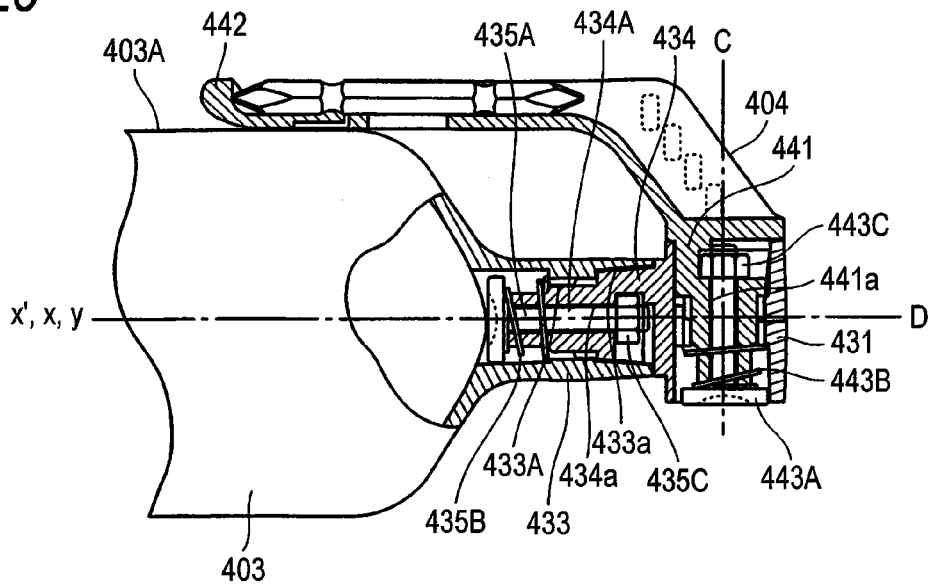
FIG. 25 is a partial bottom view showing a state of bringing a shaft portion at a periphery of a hook portion and a shaft support portion in mesh with each other in the power tool according to the fifth embodiment of the invention.

As shown by FIG. 25, a portion of the handle 403 connected to the shaft support portion 431 is provided with a pivoting connection portion 433, and a portion of the shaft support portion 431 connected to the pivoting connection portion 433 is provided with a pivoting shaft portion 434. The pivoting connection portion 433 is constituted by a circular cylinder extended from the handle 403 substantially in parallel with the intersection line x and inside thereof is formed with a support hole 433*a*. Inner teeth 433A are provided at an inner face of the support hole 433*a* and an inner face of substantially a center portion in a direction of an opening of the hole over an entire periphery thereof.

The pivoting shaft portion 434 is constituted substantially by a cylindrical shape by being extended from a side face portion of the shaft support portion 431, outer teeth 434A are provided over an entire periphery of an outer periphery of a front end portion thereof, and an axis center D orthogonal to an axis center C of a shaft portion 441 is rectified in a state of providing the shaft portion 441 to the pivoting shaft portion 434. The pivoting shaft portion 434 is inserted into the support hole 433*a* such that the outer teeth 434A and the inner teeth 433A of the pivoting connection portion 433 are brought in mesh with each other and in this case, the axis center D and the intersection line x are overlapped.

Further, the pivoting shaft portion 434 is formed with a through hole 434*a* substantially at a center thereof, a screw 435A is inserted into the through hole 434*a* such that a flange portion thereof is disposed on a front end side of a direction of inserting the pivoting shaft portion 434 and the screw 435A is fixed by a nut 435C. A spring 435B is provided between the flange portion of the screw 435A and a position proximate to the inner teeth 433A at inside of the support hole 433*a*. Therefore, the pivoting shaft portion 434 is brought into a state of being urged in the inserting direction by the spring 435B, and the inner teeth 433A and the outer teeth 434A are brought in mesh with each other to restrict pivoting relative to the pivoting connection portion 433 so far as a reaction force is not exerted against an urge force. The shaft portion 441 and the pivoting shaft portion 434 are interposed between a hook portion 404 and the handle 403, and therefore, intersecting two shafts are provided therebetween.

Figure 26:
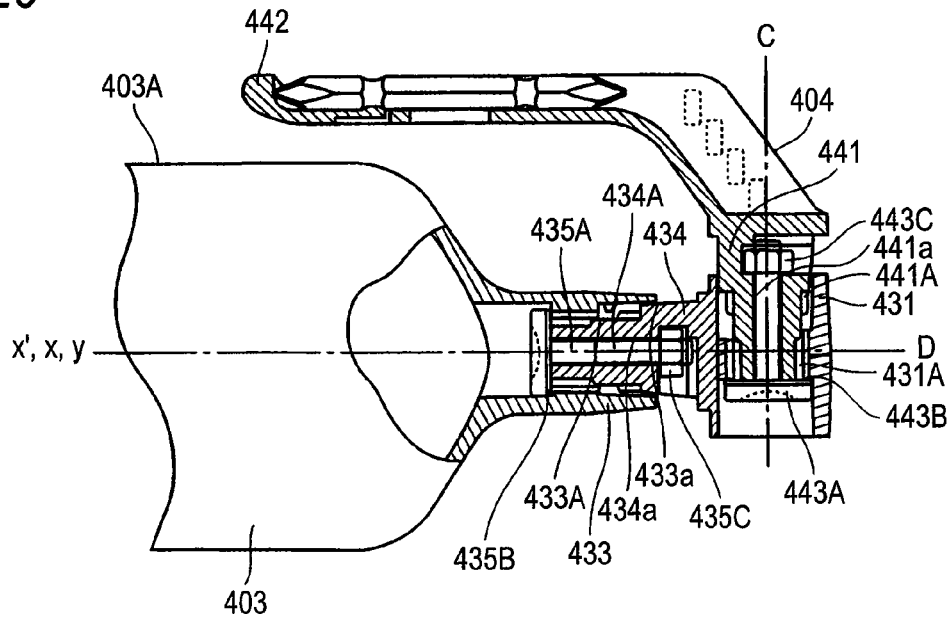
FIG. 26 is a partial bottom view showing a state of releasing the shaft portion at the periphery of the hook portion and the shaft support portion from being brought in mesh with each other in the power tool according to the fifth embodiment of the invention.
Figure 27:
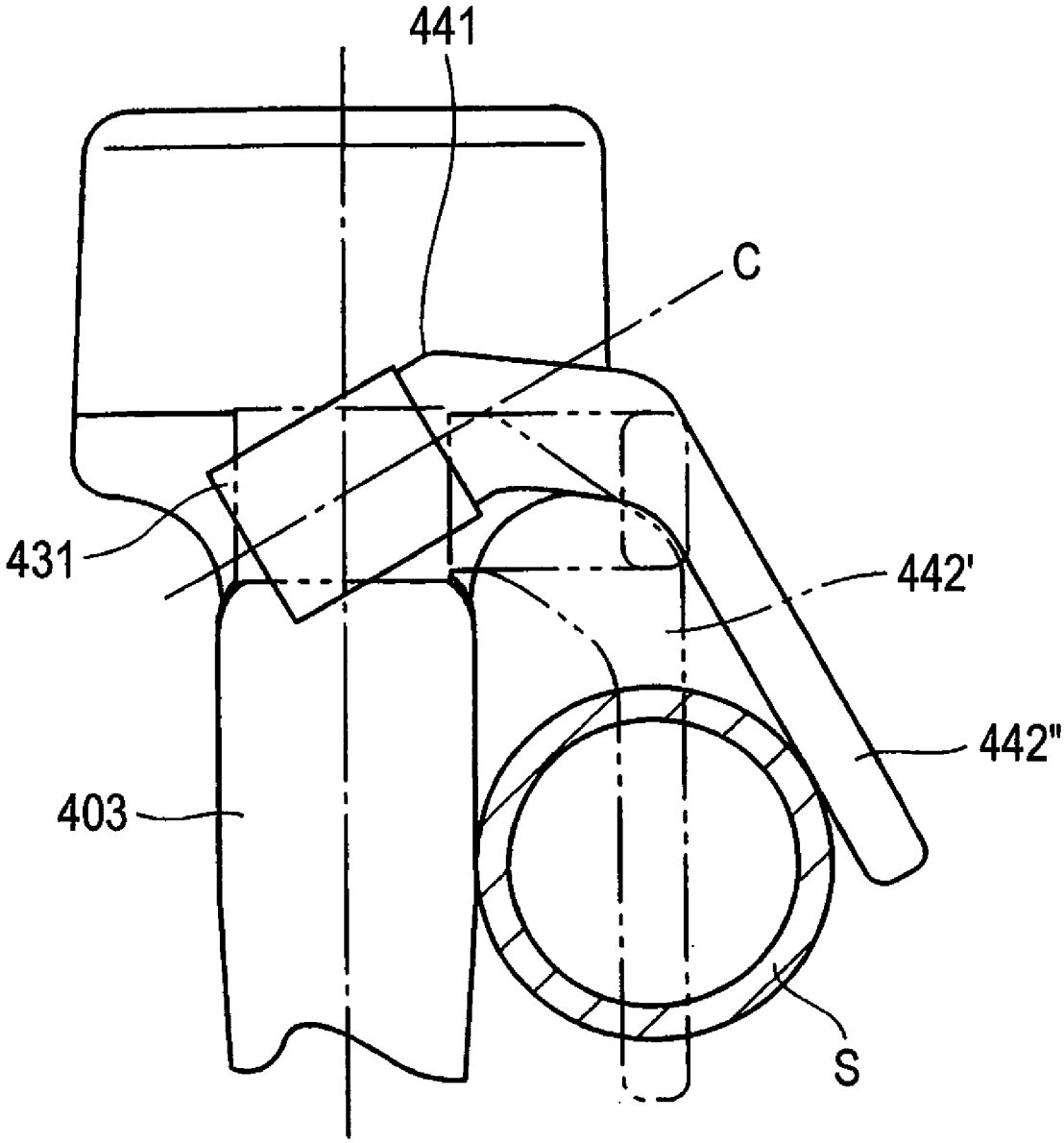
FIG. 27 is a back view showing a state of moving an arm portion to a hanging position in the power tool according to the fifth embodiment of the invention.

According to the electric driver having the above-described constitution, when a user hangs the electric driver 401 from the single pipe S or the like when the electric driver 401 is not used, as shown by FIG. 26, the shaft portion 441 is pulled in a direction against the urge force of the spring 443B to release the inner teeth 433A and the outer teeth 441A from being brought in mesh with each other. Under the state, as shown by FIG. 27, the arm portion 442 disposed at the containing position is pivoted around the axis center C to the side of the main body portion 402 (FIG. 24) (moved to the position of the arm portion 442'), and the shaft portion 441 is fixed relative to the arm support portion 431 by bringing the inner teeth 431A and the outer teeth 441 in mesh with each other.

Further, as shown by FIG. 26, the inner teeth 431A and the outer teeth 434A are released from being brought in mesh with each other by pulling the pivoting shaft portion 434 in a direction against the urge force of the spring 435B. Under the state, as shown by FIG. 27, the shaft support portion 431 is pivoted around the axis center D (FIG. 25) such that the front end of the shaft portion 441 is remote from the main body portion 402. In accordance with pivoting the pivoting shaft portion 434, the arm portion 442' is pivoted to be remote from the surface of the handle 403 to move to a position of an arm portion 442" constituting a hanging position, and therefore, an interval between the arm portion 442" and the handle 403 is widened and the electric driver 401 can be hung from the single pipe S such that the single pipe S is inserted between the handle 403 and the arm portion 442". Further, the pivoting shaft portion 434 is fixed to the pivoting connection portion 433 by bringing the inner teeth 433A and the outer teeth 434A in mesh with each other, and therefore, the single pipe S can preferably be held without widening the interval between the arm portion 442" and the handle 403 further.

By supporting the arm portion 442 by way of the shaft portion 441 and the pivoting shaft portion 434 orthogonal to each other, a locus of pivoting the front end of the arm portion 442 can three-dimensionally be constituted, and a state of making the arm portion 442 remote from the handle 403 can be provided in a state of making the arm portion 442 disposed at the hanging position.

Figure 28:
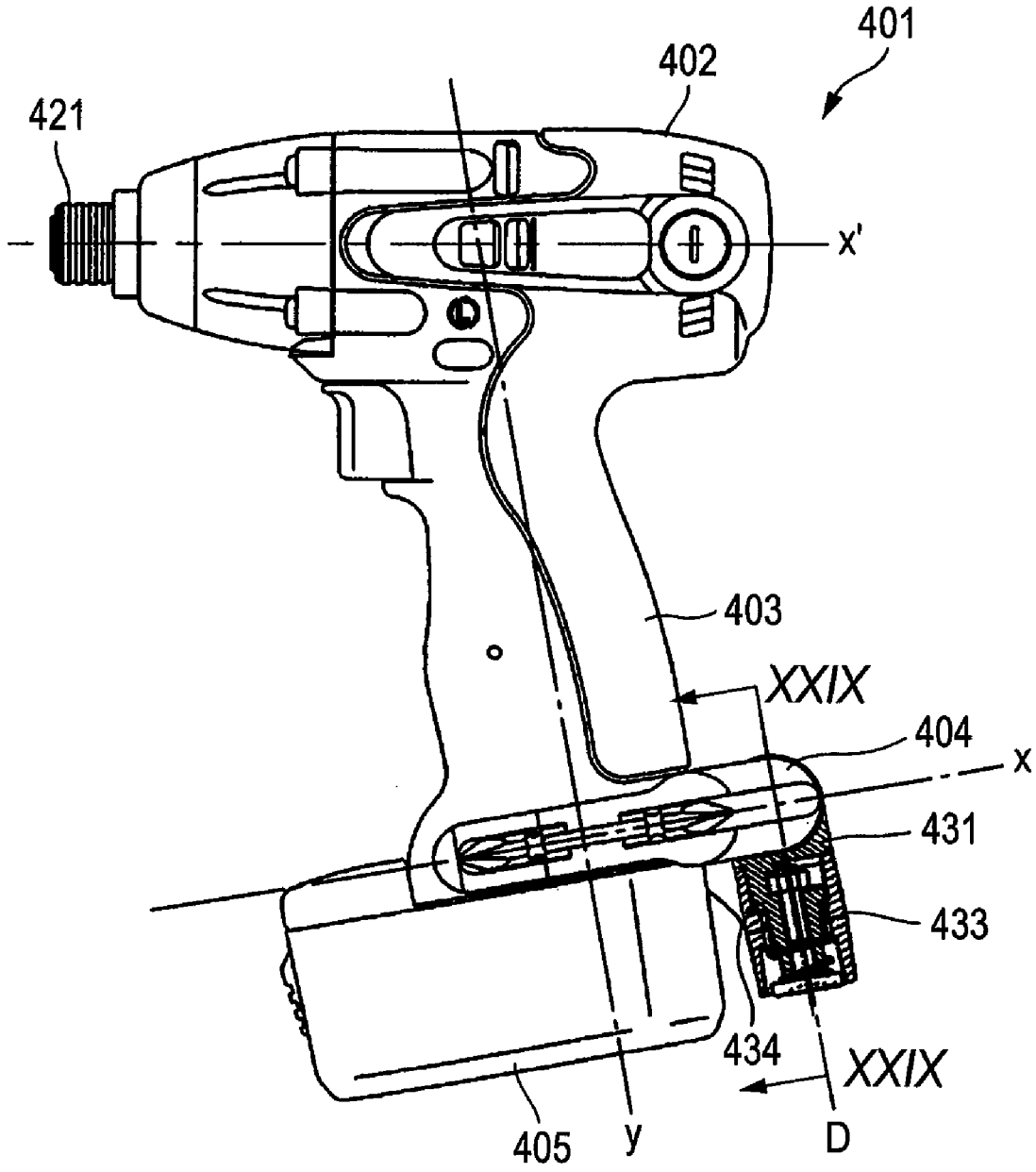
FIG. 28 is a side view showing a modified example of the power tool according to the fifth embodiment of the invention.

Further, as shown by FIG. 28, the pivoting connection portion 433 may be constituted such that an axial direction of the axis center D is substantially in parallel with an axial direction of the grabbing portion axis center y of the handle 403 so far as the constitution is constructed by a constitution including two shafts between the handle 403 and the hook portion 404.

Figure 29:
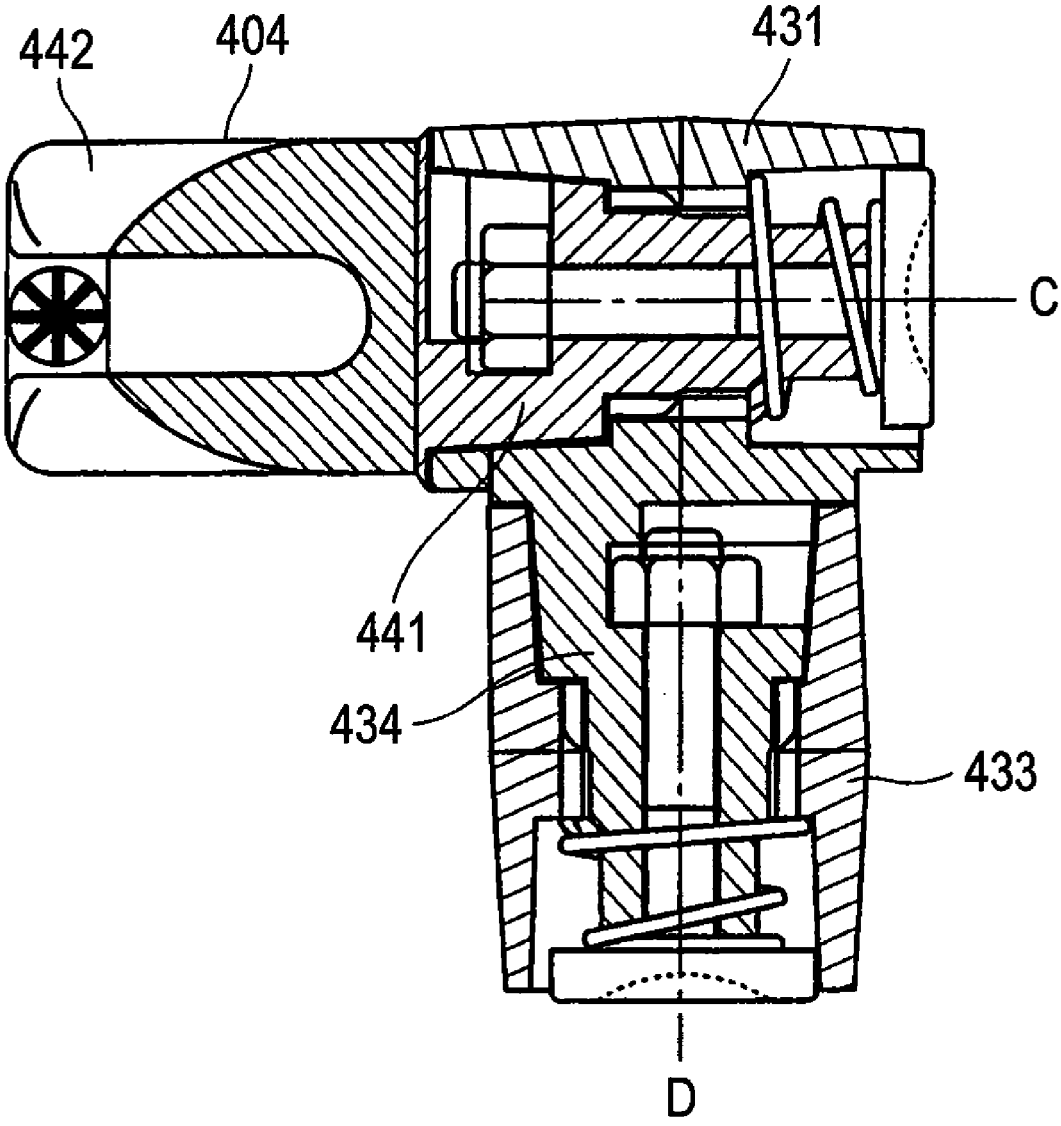
FIG. 29 is a side view showing a modified example of the power tool according to the fifth embodiment of the invention.

Even in such a constitution, the arm portion 442 can be separated from the first imaginary plane x' y by pivoting the shaft support portion 431 around the axis center D after pivoting the arm portion 442 shown in FIG. 29 around the axis center C in parallel with the first imaginary plane x' y (FIG. 28). The side face of the electric driver 401 is substantially in parallel with the first imaginary plane x' y, and therefore, even in such a constitution, the arm portion 442 can be made to be remote from the side face of the electric driver 401, specifically, from the surface of the handle 403, and the electric driver 401 can be hung from the single pipe by inserting the single pipe between the arm portion 442 and the handle 403.

Figure 30:
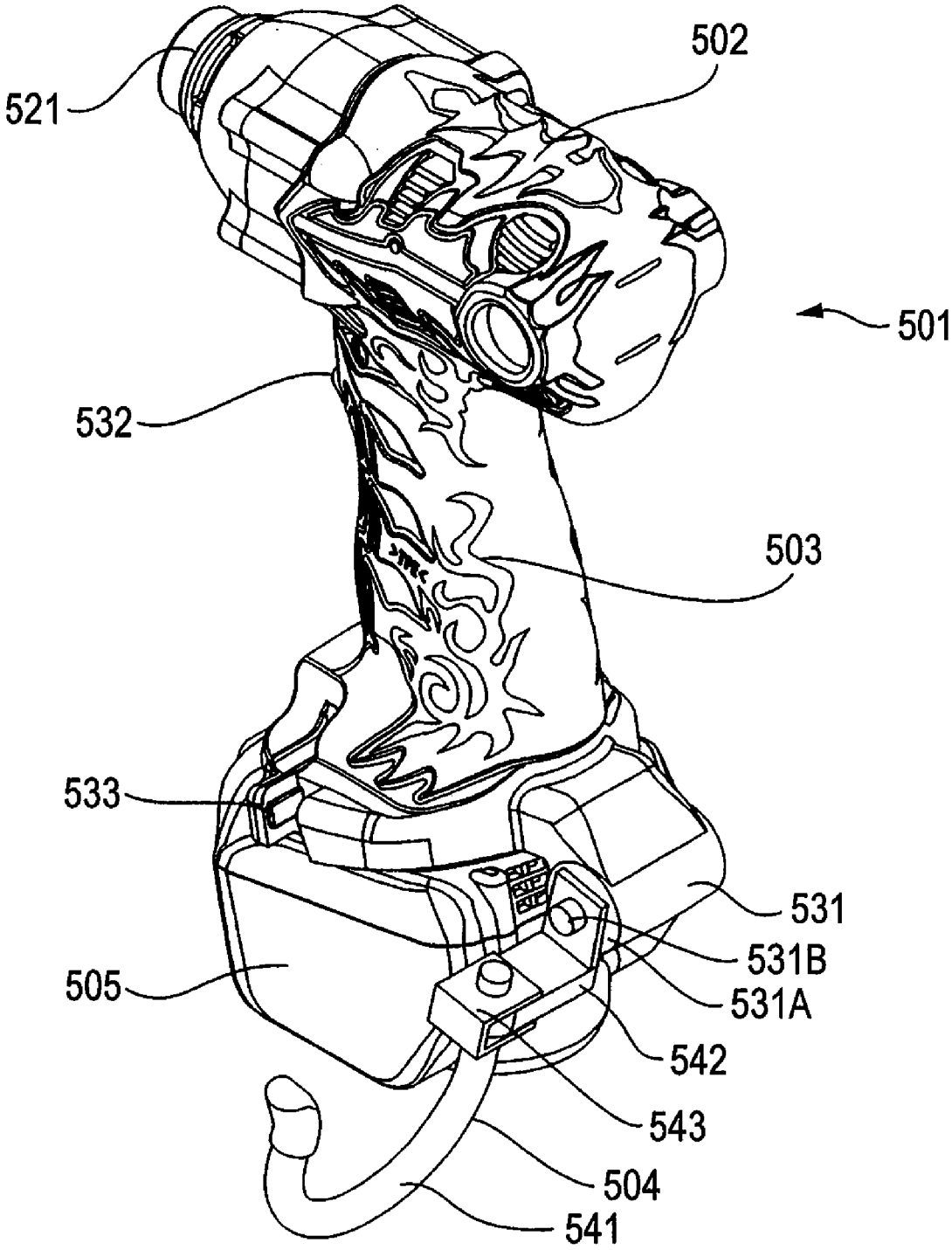
FIG. 30 is a perspective view showing a power tool according to a sixth embodiment of the invention.

Next, a power tool according to a sixth embodiment of the invention will be explained in reference to FIG. 30 through FIG. 34. As shown by FIG. 30, according to the sixth embodiment, as a power tool, an electric driver 501 will be explained.

The electric driver 501 is mainly constituted by a main body portion 502, a handle 503, a hook portion 504, and a battery 505. The main body portion 502 includes a motor, not illustrated, constituting an output portion, and a front end portion of the main body portion 502 is provided with a chuck 521 constituting an output shaft portion driven by the motor, not illustrated. A rotating shaft of the chuck 521 is in parallel with a direction of an output shaft constituting a direction directed from the main body portion 502 to the chuck 521.

The handle 503 is extended from a side face portion of the main body portion 502 in a direction of being intersected with the output shaft direction. The handle 503 is provided with the battery 505 at a front end of the extension and includes a trigger 532 at a base end of the extension and the motor, not illustrated, is controlled to drive by the trigger 532.

A front end portion of the handle 503 is provided with a pinching portion 533 constituting a slit-like shape capable of pinching a hook-like portion 541 of the hook portion 504 mentioned later. Further, a front end portion of the handle 503 is rectified with a support portion 531 for supporting the hook portion 504, and a portion of supporting the hook portion 504 of the support portion 531 is rectified with a plane 531A substantially in parallel respectively with the output shaft direction and a direction of extending the handle 503.

Figure 31:
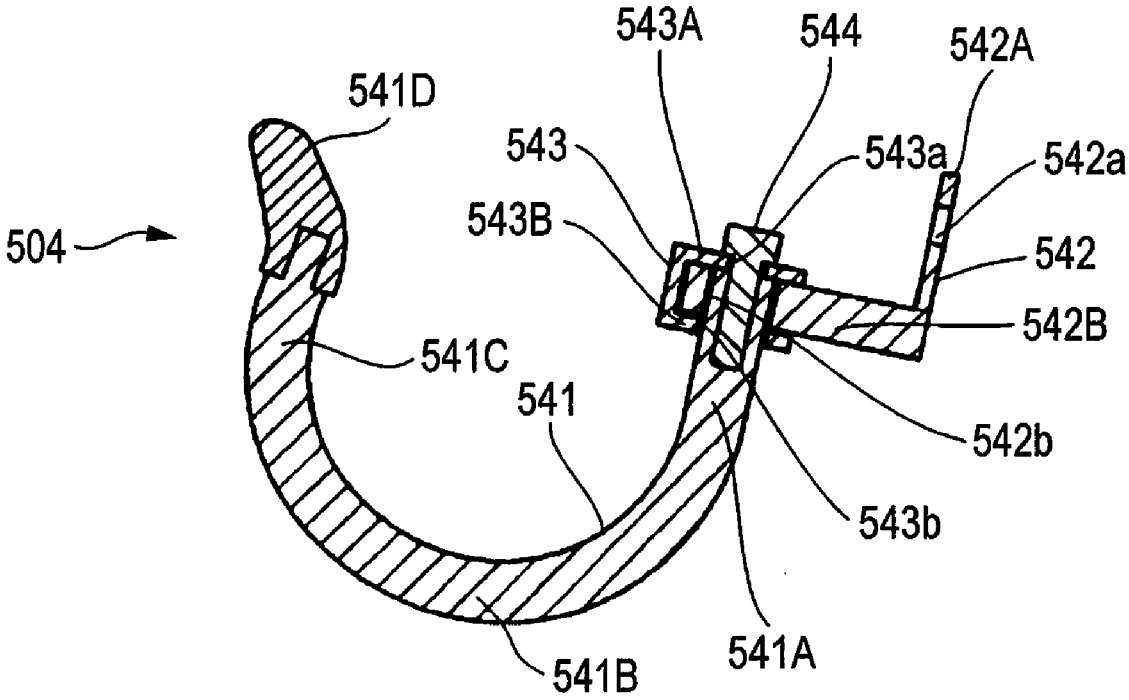
FIG. 31 is a sectional view showing a hook portion of the power tool according to the sixth embodiment of the invention.

As shown by FIG. 30 and FIG. 31, the hook portion 504 is mainly constituted by the hook-like portion 541, a first support member 542, and a second support member 543. Further, a connecting portion is constituted by the first support member 542 and the second support member 543. As shown by FIG. 31, the hook-like portion 541 is constituted by constituting a base member by a plastically deformable round bar and including a base portion 541A connected to the first support member 542 and the second support member 543, a bent portion 541B continuous to the base portion 541A, and a front end portion 541C continuous to the bent portion 541B and opposed to the base portion 541A. Further, an endmost portion of the front end portion 541C is provided with a cap 541D, and an end portion of the base portion 541A is formed with a screw hole opened in an axial direction thereof.

The first support member 542 is constituted substantially by an L-like shape by an opposed portion 542A substantially in a flat plate shape opposed to the plane 531A, and a holding portion 542B substantially in a flat plate shape for holding the base portion 541 of the hook-like portion 541.

The opposed portion 542A is formed with a hole 542*a* penetrating the flat plate, the hole 542*a* is inserted with a screw 531B to attach the first support member 542 to the support portion 531. The screw 531B is screwed to the support portion 531 in a state of not being fastened to a flange portion thereof, and therefore, the first support member 542 is made to be pivotable by constituting a pivoting shaft by the screw 531B in a state of making the opposed portion 542A and the plane 531A opposed to each other. In this case, a direction of the pivoting shaft of the screw 531B and a direction of penetrating the hole 542*a* become the same direction and the direction of the pivoting shaft of the screw 531B and the plane 531A are orthogonal to each other.

The holding portion 542B is formed with a hole 542*b* penetrating a flat plate thereof. The hole 542*b* is formed such that a penetrating direction thereof is substantially orthogonal to the direction of penetrating the hole 542*a* and a hole diameter thereof is slightly larger than a diameter of the base portion 541A.

The second support member 543 is formed by folding to bend one sheet of a flat plate to provide a pair of flat plate portions 543A, 543B opposed to each other and in parallel with each other. The pair of flat plate portions 543A, 543B are respectively provided with holes 543*a*, 543*b* substantially at center positions of the respective flat plates. A hole diameter of the hole 543*b* is formed to be substantially the same as a diameter of the hole 542*b* of the holding portion 542B and a hole diameter of the hole 543*a* is formed to be smaller than the hole diameter of the holding portion 542B.

In a state in which the holding portion 542B of the first support member 542 is inserted to between the pair of flat plate portions 543A, 543B of the second support member 543 and the hole 542*b* and the hole 543*b* are disposed on the same axis, an end portion of the base portion 541A is inserted into the hole 542*b* and the hole 543*b*. By inserting a screw 544 into the hole 543*a* to be screwed with the base portion 541A under the state, the hook-like portion 541 is attached to the first support member 542 and the second support member 543. The screw 544 is screwed to the base portion 541A in a state of not being fastened to the flange portion, and therefore, the hook-like portion 541 is made to be pivotable by constituting a pivoting shaft by the screw 544 in a state of being attached to the first support member 542 and the second support member 543. In this case, a direction of a pivoting shaft of the screw 544 and a direction of penetrating the hole 542*b* become the same. A pivoting axis around the screw 544 of the base portion 541A is defined as a first pivoting axis center 544 and a pivoting axis around the screw 531B of the first support member 542 is defined as a second pivoting axis center 531B.

Therefore, the hook-like portion 541 includes two axes of the first pivoting axis and the second pivoting axis between the hook-like portion 541 and the handle 503. Therefore, the hook-like portion 541 can be pivoted around one axis and can be pivoted around two axes intersecting with the one axis, and therefore, a locus of pivoting the front end portion 541C can three-dimensionally be constituted.

Figure 32:
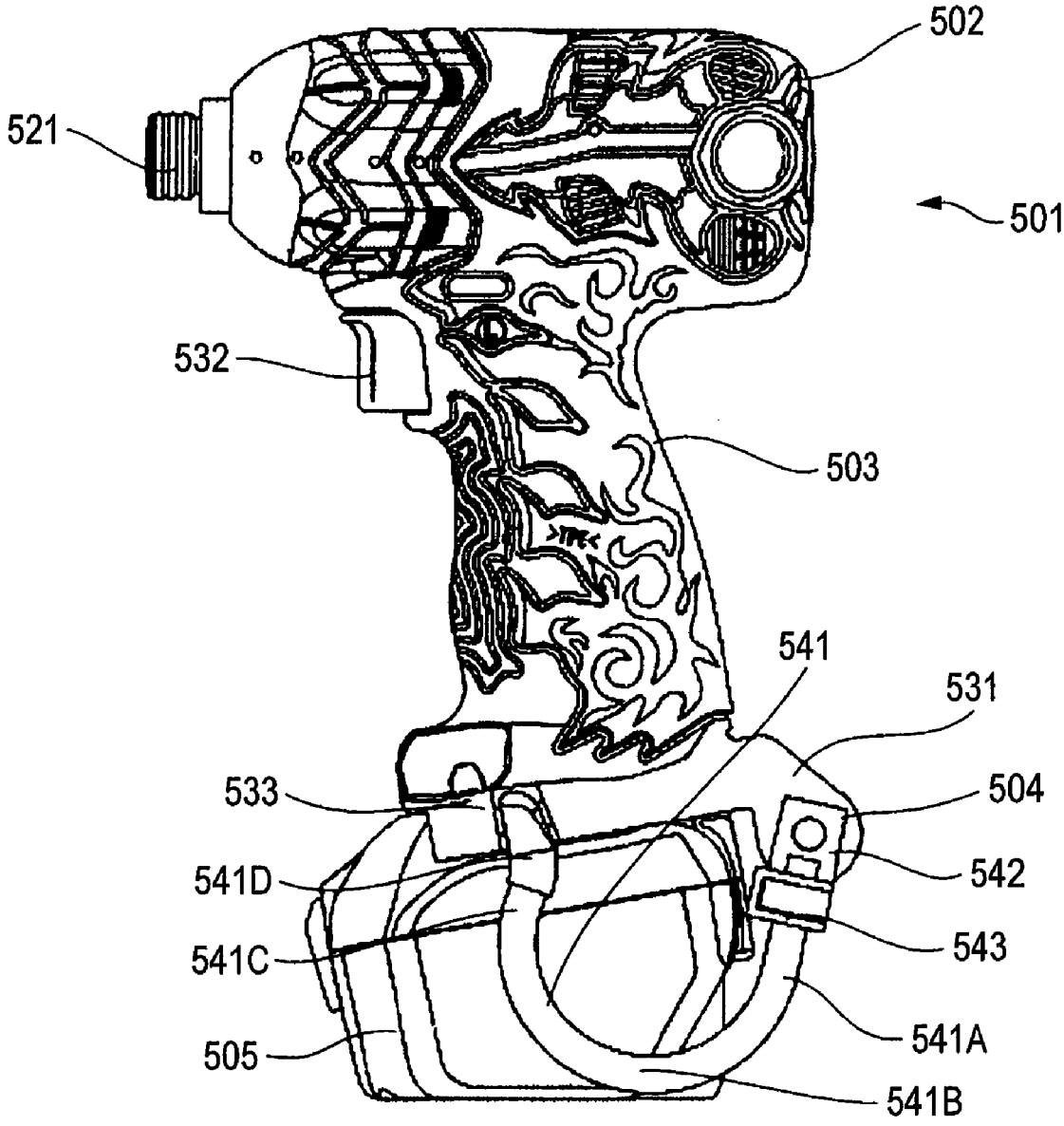
FIG. 32 is a side view showing the power tool according to the sixth embodiment of the invention.

When operation is carried out in the electric driver 501 having the above-described constitution, as shown by FIG. 32, by pivoting the hook-like portion 541, the front end portion 541C and the cap 541D are held by the pinching portion 533. Thereby, the hook portion 504 can be restrained from being rattled in the operation and the operation can preferably be carried out.

Figure 33:
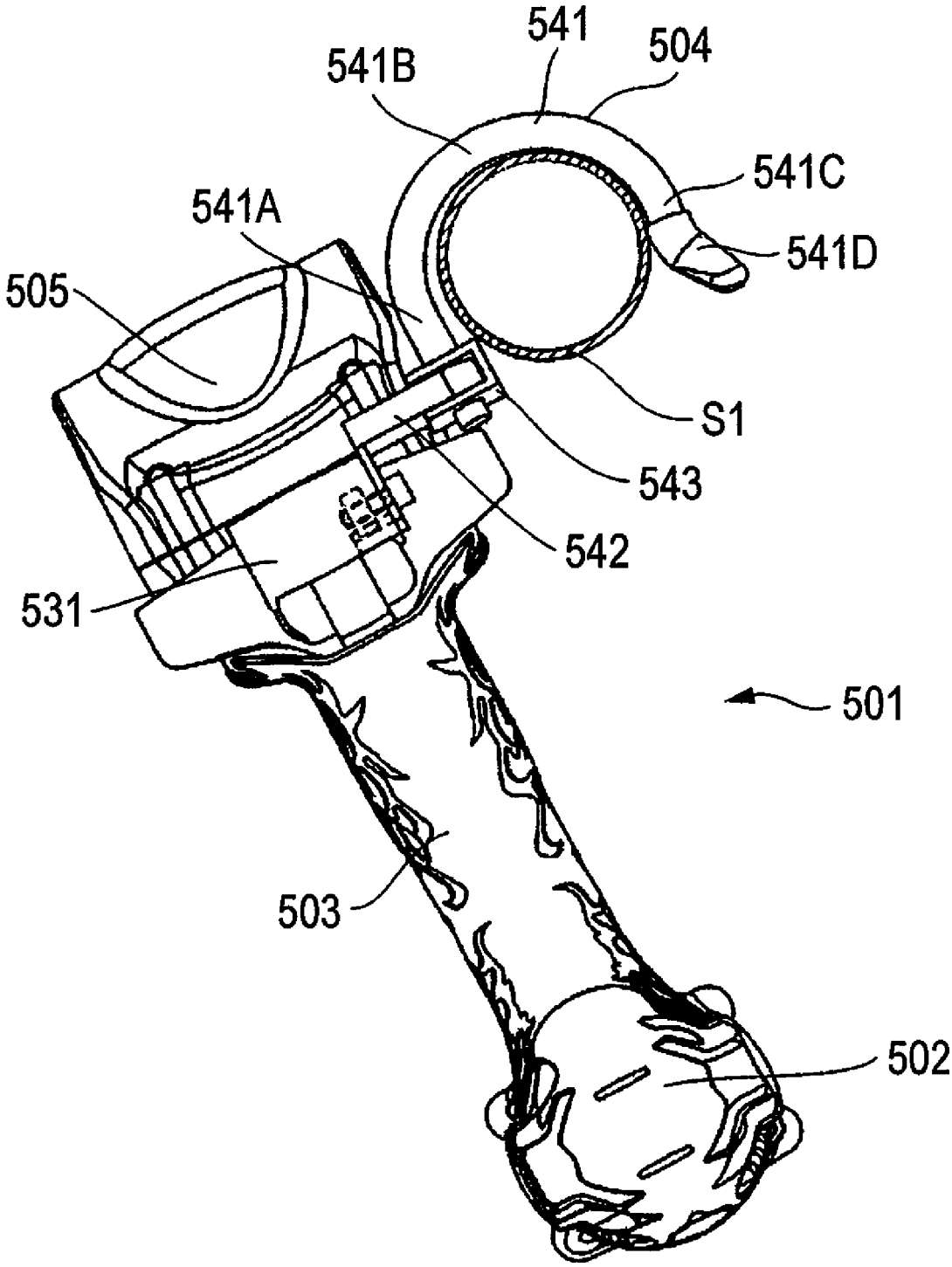
FIG. 33 is a back view showing the power tool according to the sixth embodiment of the invention (state of hanging from single pipe)

When the electric driver 501 is not used, as shown by FIG. 33, the hook-like portion 541 is detached from the pinching portion 533, and pivoted around the first pivoting axis center 544 to arrange the front end portion 541C at a position remote from the handle 503. Under the state, the electric driver 501 is hung from the single pipe S1.

According to the electric driver 501, the gravitational center position is disposed at the position of the main body portion 502 since the main body portion 502 is provided with a motor or the like, not illustrated. Further, the hook portion 504 is provided at the front end portion in the direction of extending the handle 503. Therefore, when the electric driver 501 is hung by the hook portion 504, the main body portion 502 can be disposed on the lower side of the hook portion 504 and can be hung stably.

Further, the second pivoting axis center 531B is interposed between the hook-like portion 541 of the hook portion 504 and the handle 503, and therefore, the main body portion 502 and the like can be pivoted in a state of a pendulum in a direction in parallel with the plane 531A, that is, this side and the depth side of paper face of FIG. 23 by constituting a fulcrum by the second pivoting axis center 531B. Thereby, in a state of hanging the electric driver 501 from the single pipe S1, the gravitational center position of the electric driver 501 is arranged at a position hung from the hook-like portion 541 without moving the hook-like portion 541. Therefore, the electric driver 501 can be held further stably.

Further, there is a case in which the electric driver 501 is swayed by bringing other operator or the like into contact with the electric driver 501. Also in this case, the main body portion 502 and the like can be pivoted relative to the hook-like portion 541 by constituting fulcra by the first pivoting axis center 544 and the second pivoting axis center 531B and the sway can be restrained from being transmitted to the hook portion 504 including the hook-like portion 541. Therefore, the hook-like portion 541 can be restrained from being detached from the single pipe S1 and a stability of a state of hanging the electric driver 501 can be increased.

Figure 34:
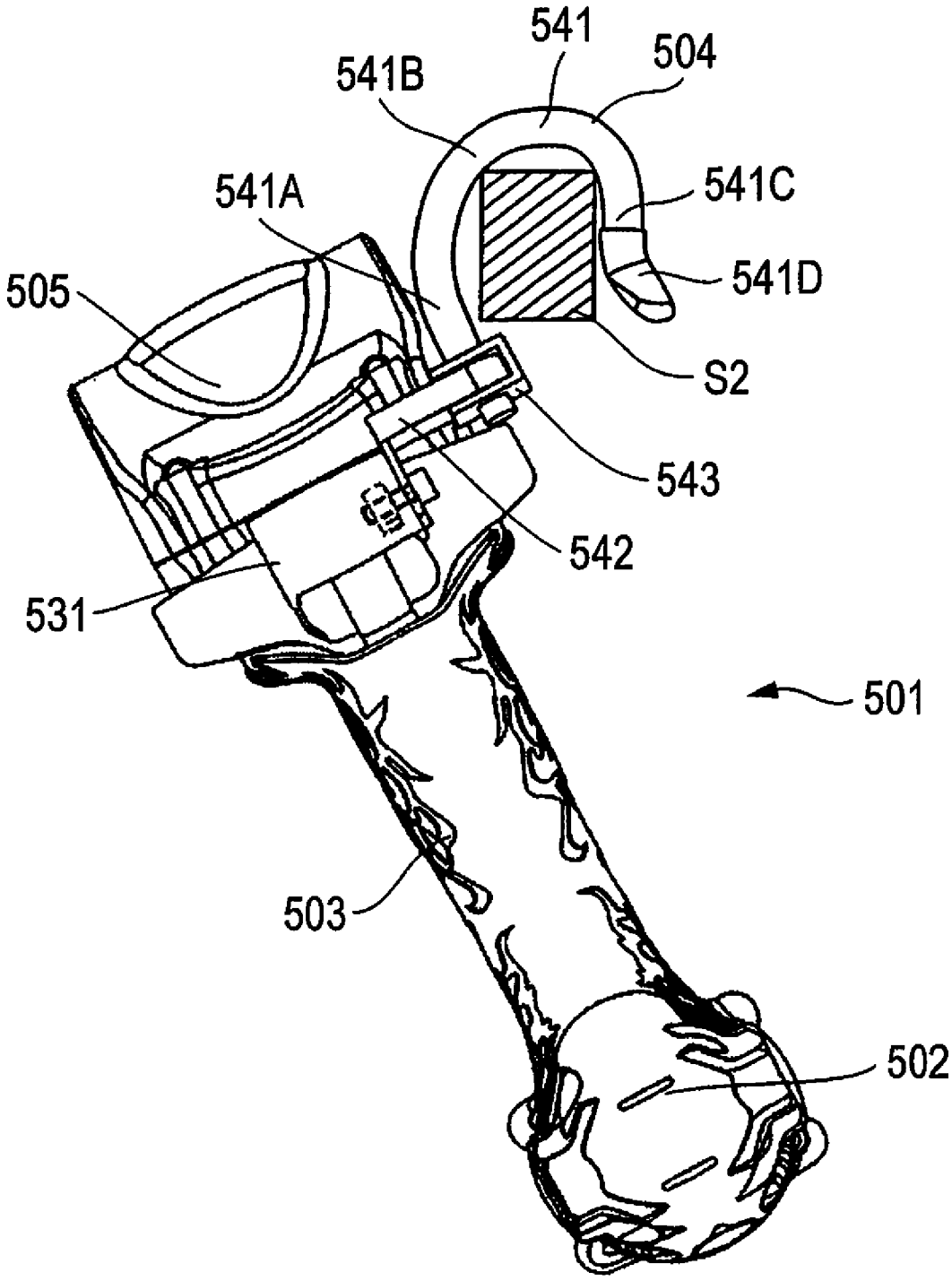
FIG. 34 is a back view showing the power tool according to the sixth embodiment of the invention (state of hanging from wood member)

When the hung member is considerably smaller than an opening width of the hook-like portion 541 (a width between the base portion 541A to the front end portion 541C) shown in FIG. 32 and FIG. 33, as shown by FIG. 34, the front end portion 541C is made to be proximate to the base portion 541A by folding to bend the bent portion 541B. Thereby, when the hook-like portion 541 is hung from a wood member S2 a width of which is smaller than that of the single pipe S1 (FIG. 33), a gap between the wood member S2 and the hook-like portion 541 is reduced and the hook-like portion 541 can be hung from the wood member S2 stably. Therefore, so far as the width of the hung member is constituted by a width at least capable of hanging the electric driver 501 by the hook-like portion 541 by folding to bend the bent portion 541B, in any of the width of the hung member, the hook portion 504 can stably be hung and the electric driver 501 can stably be hung.

Figure 35:
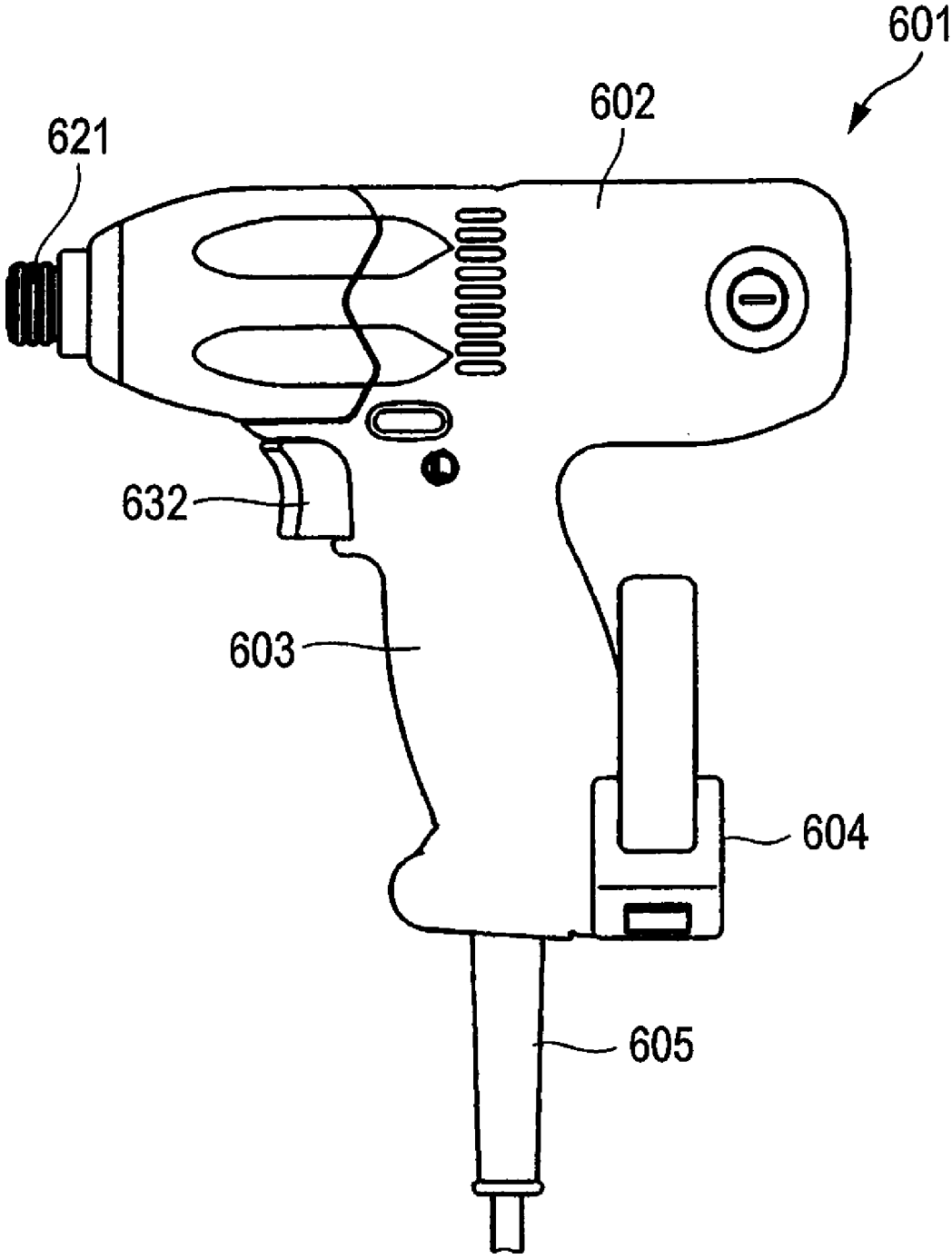
FIG. 35 is a side view showing a power tool according to a seventh embodiment of the invention.

Next, a power tool according to a seventh embodiment of the invention will be explained in reference to FIG. 35 to FIG. 41. As shown by FIG. 35, according to the seventh embodiment, as a power tool, an electric driver 601 will be explained. The electric driver 601 according to the seventh embodiment is provided with a characteristic substantially the same as that of the impact driver 101 according to the second embodiment, although according to the impact driver 101, the shaft portion 145 is arranged to be substantially orthogonal to the output shaft direction and the direction of extending the handle 103, according to the electric driver 601, a shaft portion 645 (FIG. 37) is extended to be skewedly intersected with the output shaft direction and a direction of extending a handle 603. Therefore, with regard to a main constitution and a constitution other than the characteristic point of the invention, an explanation thereof will be omitted by adding 500 to notations related to the impact driver 101 according to the second embodiment.

The electric driver 601 shown in FIG. 35 is mainly constituted by a main body portion 602, a handle 603, and a hook portion 604. The main body portion 602 includes a motor, not illustrated, constituting an output portion, and a front end portion of the main body portion 602 is provided with a chuck 621 constituting an output shaft portion rotated by being driven by the motor, not illustrated. A rotating shaft of the chuck 621 is in parallel with the output shaft direction constituting a direction directed from the main body portion 602 to the chuck 621.

The handle 603 constituting a grabbing portion is extended from a side face portion of the main body portion 602 in a direction of being intersected with the output shaft direction. The handle 603 is provided with a power source cord for supplying power to the motor, not illustrated, at a front end of the extension and includes a trigger 632 at a base end of the extension and the motor, not illustrated, is controlled to drive by the trigger 632.

Figure 36:
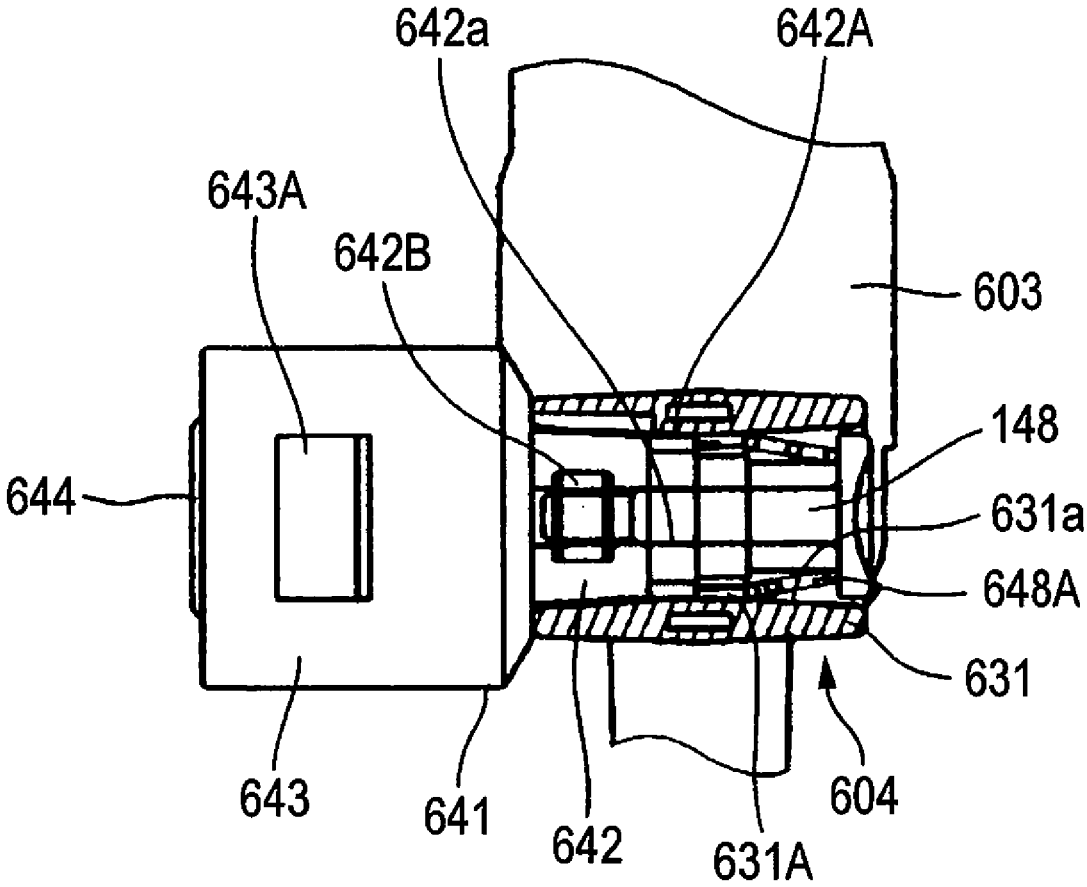
FIG. 36 is a sectional view showing a periphery of a rotation support portion of the power tool according to the seventh embodiment of the invention.

A shown by FIG. 36, the hook portion 604 is mainly constituted by a rotation support portion 631 provided at a front end in a direction of extending the handle 603, a shaft support portion 641 supported by the rotation support portion 631, and an arm portion constituting portion 644 provided at an end portion of the shaft support portion 641. The shaft support portion 641 is mainly constituted by a rotating shaft portion 642 and a receiving portion 643. A constitution with regard to connection of the rotation support portion 631 and the receiving portion 643 is the same as that of the impact driver 101 according to the second embodiment, and therefore, an explanation thereof will be omitted.

Figure 37:
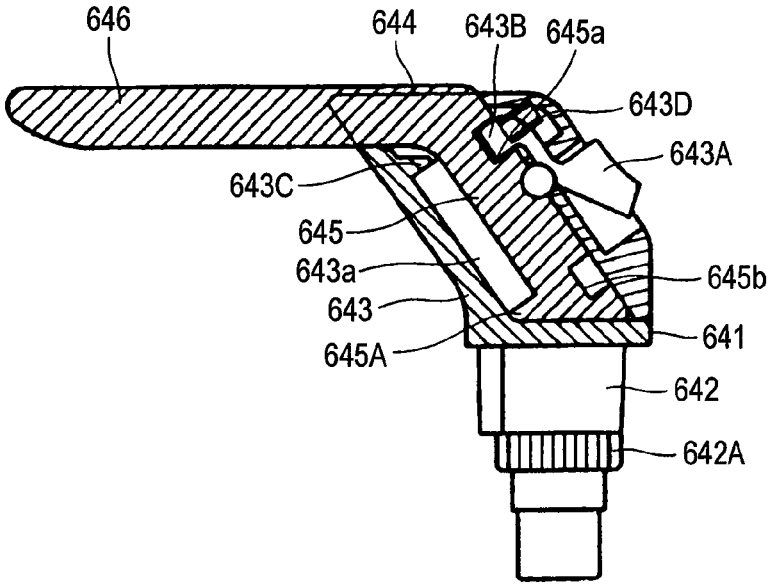
FIG. 37 is a sectional view of a shaft support portion of the power tool according to the seventh embodiment of the invention (state of contracting shaft portion)

As shown by FIG. 37, the receiving portion 643 is formed with a hole 643*a* directed from an end portion on a side opposed to the rotating shaft portion 642 a side of the rotating shaft portion 642, and the shaft portion 645, mentioned later, is made to be able to be inserted into the hole 643*a*. Further, the hole 643*a* is formed such that a boring direction thereof does not coincide with an axial direction of the rotating shaft portion 642 but is skewedly intersected therewith. The rotating shaft portion 642 is supported by the rotation support portion 631 (FIG. 36) such that an axis thereof is substantially orthogonal to a direction of the output shaft of the electric driver 601 and a direction of extending the handle 603. Therefore, the hole 643*a* is constituted such that a boring direction thereof is skewedly intersected with the output shaft direction of the electric driver 601 and the direction of extending the handle 603 in a state of mounting the shaft support portion 641 to the rotation support portion 631.

A wall of the receiving portion 643 partitioning the hole 643*a* of the receiving portion 643 is provided with a notch 643A constituting a hanging portion. The notch 643A is provided with a claw 643B, and the claw 643B is projected into the hole 643*a*. A spring 643D constituting an urging member is interposed between the notch 643A and the wall partitioning the hole 643*a* and the notch 643A is urged by the spring 643D and the claw 643B is always projected into the hole 643*a*. Further, when the notch 643A is pressed against the spring 643D, the claw 643B is made to be able to be moved from a state of being projected into the hole 643*a* to a state of being pulled back therefrom. A wall face of the receiving portion 643 at a vicinity of the opening of the hole 643*a* and constituting an inner face is provided with a detach stop 643C projected to a center side in a diameter direction of the hole 643*a* for preventing the shaft portion 645, mentioned later from being detached from the receiving portion 643.

The arm portion constituting portion 644 is mainly constituted by the shaft portion 645 and the arm portion 646. The shaft portion 645 is constituted substantially by a shape of a circular column inserted into the hole 643*a* and slidable, and includes the arm portion 646 at one end portion constituting a rear end in the direction of being inserted into the hole 643*a*. Further, a side face of the shaft portion 645 is respectively formed with a first recess portion 654*a* and a second recess portion 645*b* constituting a plurality of hung portions aligned to be arranged from a side of one end portion to a side of other end portion. The first recess portion 654*a* and the second recess portion 645*b* are respectively engageable with the claw 643B. Further, other end of the shaft portion 645 is provided with a projected portion 645A projected from a side face thereof to an outer side in a diameter direction. The projected portion 645A is constituted to be able to be brought into contact with the detach stop 643C when the shaft portion 645 is slid at inside of the hole 643*a*.

The arm portion 646 is integrally molded with the shaft portion 645 from a resin or the like of an elastic material. Further, the arm portion 646 is constituted such that the direction of extending from the shaft portion 645 is in parallel with the plane rectified by the output shaft direction of the electric driver 601 and an extending direction of the handle 603 in a state of mounting the arm portion constituting portion 644 to the shaft support portion 641 and mounting the shaft support portion 641 to the rotation support portion 631.

When an operation is carried out by the electric driver 601 having the above-described constitution, the arm portion 646 is arranged to be substantially in parallel with an axial direction of the main body portion 602 and the claw 643B is hung from the first recess portion 645*a*. Thereby, the arm portion 646 is arranged substantially at a vicinity of a surface of the handle 603 to restrain the electric driver 601 from hindering the operation.

Figure 38:
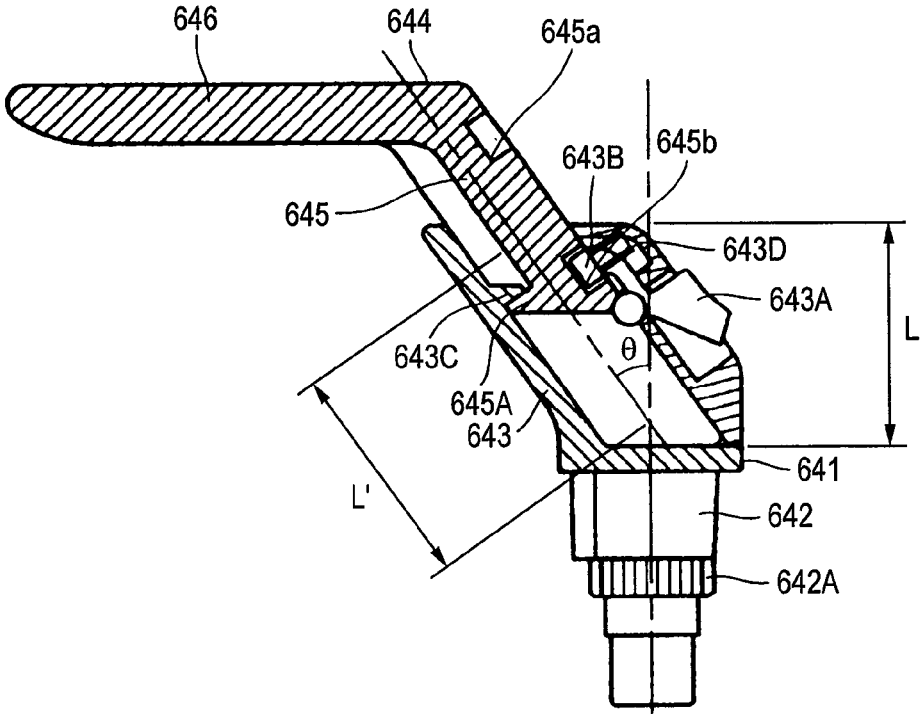
FIG. 38 is a sectional view of the shaft support portion of the power tool according to the seventh embodiment of the invention (state of elongating shaft portion)
Figure 39:
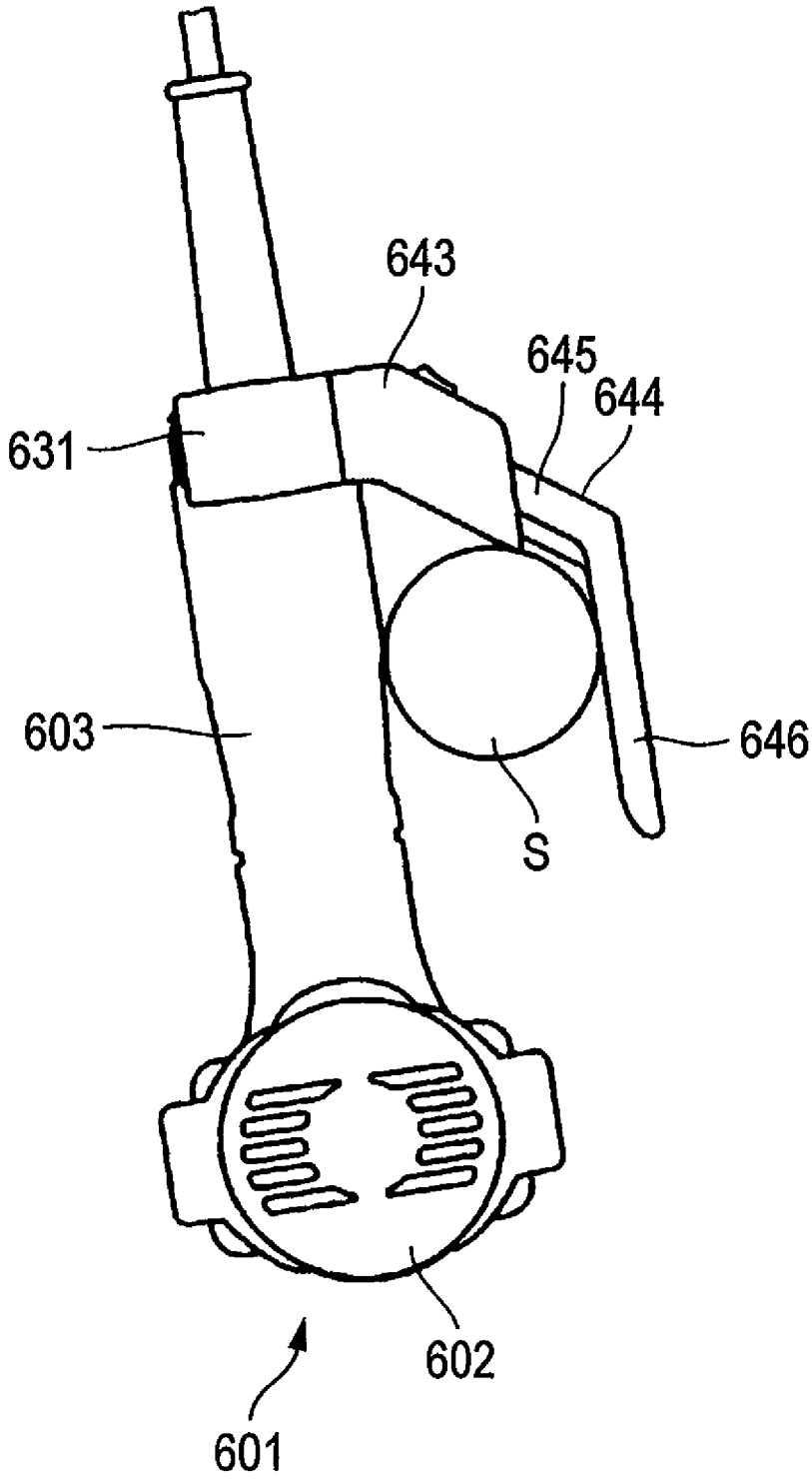
FIG. 39 is a back view of a state of hanging the power tool according to the seventh embodiment of the invention from the hung member (single pipe)

When the operation is interrupted and the electric driver 601 is hung from a bold member of a single pipe or the like, as shown by FIG. 38, the notch 643A is pressed to release the claw portion 643B and the first recess portion 654*a* from being engaged with each other and the arm portion constituting portion 644 is pulled to move the claw portion 643*b* and the second recess portion 645*b* to a position of being engageable with each other. The position, the notch 643A is stopped to press and the claw portion 643B and the second recess portion 645*b* are engaged with each other. Thereby, as shown by FIG. 39, in a state in which an interval between the arm portion 646 and the handle 603 is widened, the arm portion constituting portion 644 including the shaft portion 645 is fixed to the shaft support portion 641 to be able to hang from the single pipe S. Further, the arm portion 646 is constituted by the elastic material, and therefore, even when a diameter of the single pipe S is larger than the distance between the arm portion 646 and the handle 603, the single pipe S can be pinched up to a width thereof to some degree.

Figure 40A:
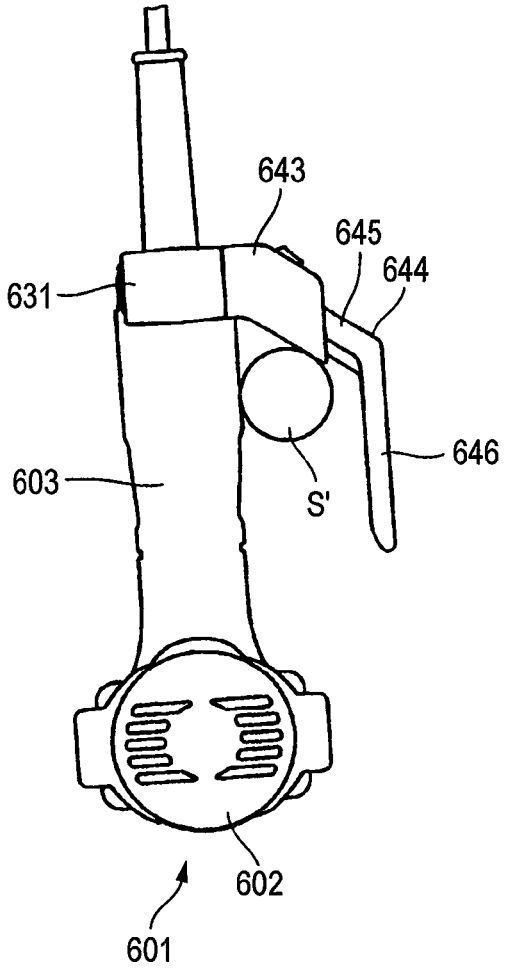
FIGS. 40A, 40B illustrate back views of a state of hanging the power tool according to the seventh embodiment of the invention from a hung member (FIG. 40A pipe FIG. 40B square member)
Figure 40B:
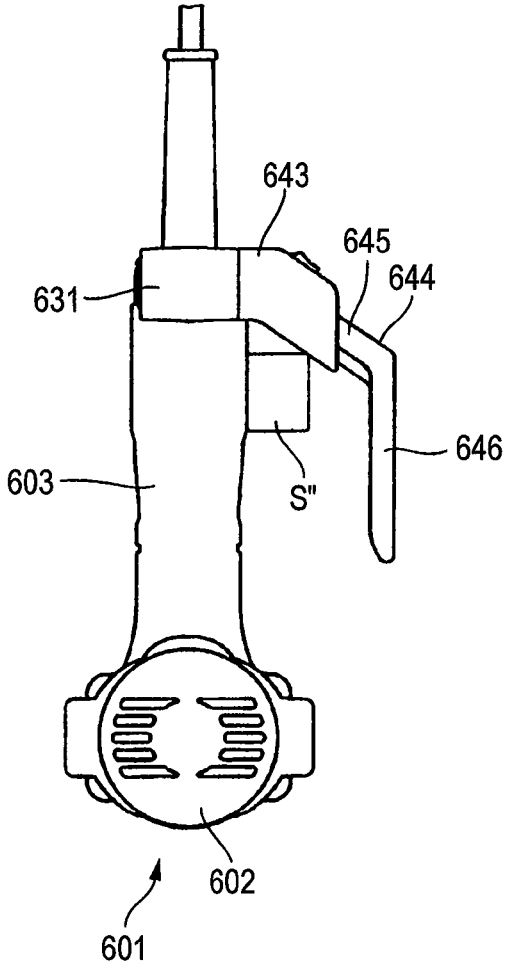

As shown by FIGS. 40A, 40B, when the electric driver 601 is hung from a slender pipe S' or a square member S" in a state of expanding the arm portion 646, the shaft portion 645 and the receiving portion 643 for receiving to support the shaft portion 645 are constituted to be skewed to the axial direction of the rotating shaft portion 642, and therefore, the pipe S' or the square member S" is disposed at a surface of the handle 603 and at a vicinity of an extended portion of the receiving portion 643. Therefore, when the electric driver 601 is hung from the pipe S' or the square member S" constituting a slender hung member, the handle 603 can be hung to be proximate to the pipe S' or the square member S" without shortening the distance between the arm portion 646 and the handle 603 and the electric driver 601 can stably be hung therefrom.

As shown by FIG. 38, in a case in which an angle between a center axis of the rotating shaft portion 642 and the center axis of the hole 643*a* is designated by notation θ, when a distance of the hole 643*a* along the center axis of the rotating shaft portion 642 is designated by notation L, a distance along the center axis of the hole 643*a* becomes L'=L/cos θ. Under the relationship, the distance along the center axis of the hole 643*a* can be made to be longer in a case of 90°>θ>0° than in a case of θ=0° in which the center axis of the hole 643*a* and the center axis of the rotating shaft portion 642 coincide with each other. By making the distance along the center axis of the hole 643*a* long, a distance of being inserted into the hole 643*a* of the shaft portion 645 becomes long and a fitting portion can be made to be long. Therefore, by making the fitting portion long, rattle of the shaft portion 645 held by the receiving portion 643 is reduced and even when a width between the arm portion 646 and the handle 603 is made to be wide, the shaft portion 645 can firmly be held by the receiving portion 643.

Figure 41:
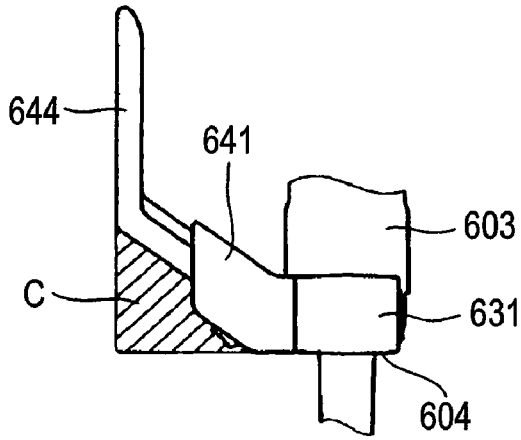
FIG. 41 is a partial back view showing a periphery of a hook portion of the power tool according to the seventh embodiment of the invention.

Further, as a shape of the hook portion 604, by adding the angle to direction of sliding the shaft portion 645 relative to the rotating shaft portion 642, in comparison with a case in which the direction of sliding the shaft portion 645 is made to be a direction the same as the axial direction of the rotating shaft portion 642, in a region indicated by a region C (hatched portion) shown in FIG. 41, a possibility that the hook portion 604 interferes with a hung member, a hazard or the like is reduced and the operability of the electric driver 601 can be promoted.

Although the electric driver 601 constituting the power tool according to the seventh embodiment is constituted by a shape of including a plurality of hung portions, the invention is not limited thereto but conversely, a plurality of hanging portions may be provided, the hung portion is hung from the plurality of hanging portion, and an amount of extending the shaft portion from the shaft support portion may be rectified.

Figure 42:
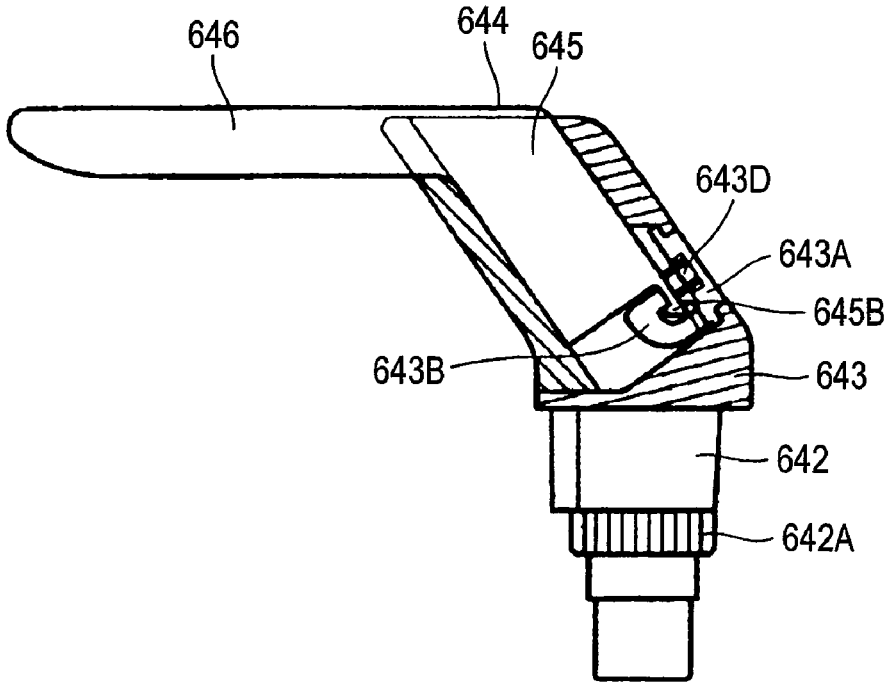
FIG. 42 is a sectional view of a shaft support portion constituting a modified example of the power tool according to the seventh embodiment of the invention (state of contracting the shaft portion)
Figure 43:
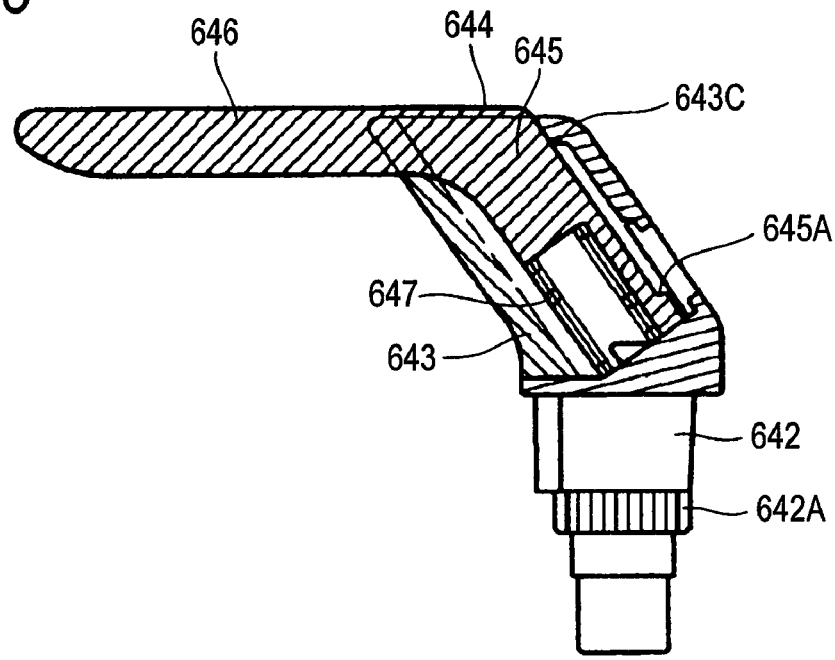
FIG. 43 is a sectional view of an arm portion constituting the modified example shown in FIG. 42 (state of contracting the shaft portion)
Figure 44:
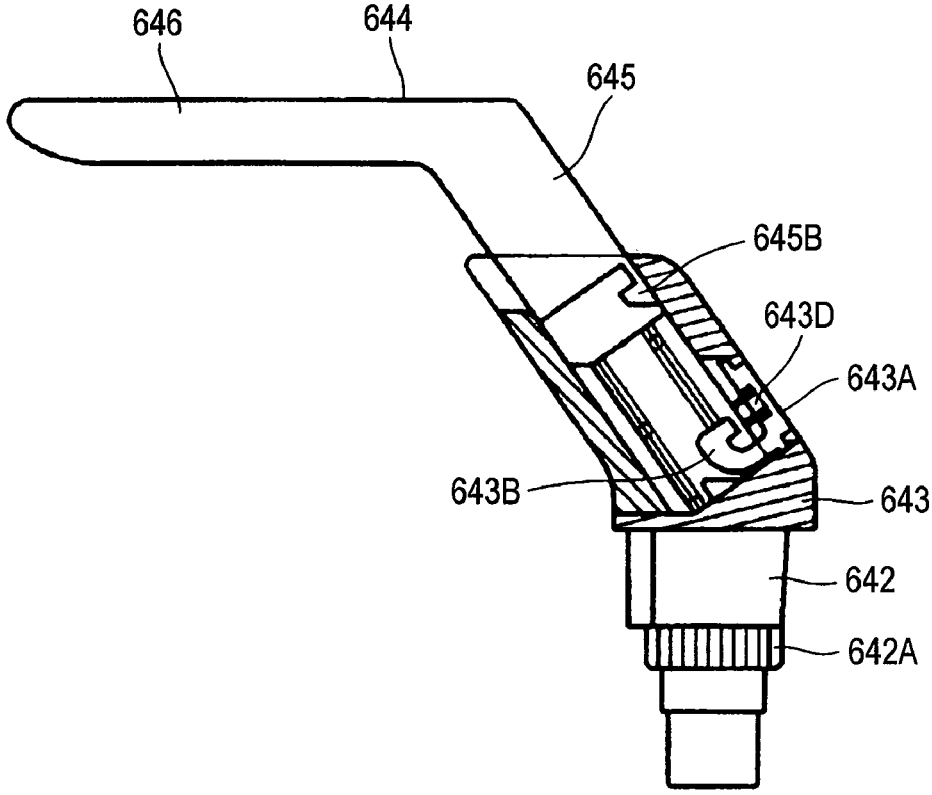
FIG. 44 is a sectional view of a shaft support portion constituting the modified example shown in FIG. 42 (state of elongating the shaft portion).

Further, as a modified example, as shown by FIG. 42 through FIG. 44, a constitution including a pair of a hanging portion and a hung portion may be adopted. In the constitution, a vicinity of a position of connecting the receiving portion 643 to the rotating shaft portion 642 is provided with a notch 643A the claw 643B of which is projected into the hole 643*a*. A wall face of the receiving portion 643 at a vicinity of the opening of the hole 643*a* and constituting the inner face is provided with the detach stop 643C projected to the side of the center in the diameter direction of the hole 643*a*. The shaft portion 645 is provided with the arm portion 646 at one end thereof and the hung portion 645B is provided at other end of the shaft portion 645. Further, as shown by FIG. 43, other end of the shaft portion 645 is provided with the projected portion 645A projected from the side face to the outer side in the diameter direction and capable of being brought into contact with the detach stop 643C. Further, at inside of the hole 643*a*, the spring 647 for urging the shaft portion 645 to the side opposed to the rotating shaft portion 642 is provided between the shaft portion 645 and the receiving portion 643.

In the constitution, the arm portion constituting portion 644 including the arm portion 646 can take a state in which the claw 643B shown in FIG. 42 is hung from the hung portion 645B and a state in which the claw 643B shown in FIG. 44 is released from the hung portion 645B. In a state in which the claw 643B is hung from the hung portion 645B, the arm portion 646 is disposed at a vicinity of the handle, not illustrated, in the state in which the claw 643B is released from the hung portion 645B, the shaft portion 645 is urged by the spring 647, and therefore, the arm portion 646 is separated from the handle, not illustrated. Therefore, even in the constitution including the pair of the hanging portion and the hung portion, the arm portion can take two positions of a position proximate to the handle constituting the grabbing portion and the position separated therefrom and the arm portion can be arranged at a pertinent position in accordance with a boldness of the hung member.

Further, a slip stop member of elastomer or the like may be arranged at a portion of the arm portion brought into contact with the hung member. Thereby, friction is generated between the hung member and the arm portion, and therefore, when the power tool is hung, the power tool can further stably be hung.

The invention is the power tool driven by electricity, compressed air, a fuel or the like and is applicable generally to the power tool which a user grabs to carry out an operation.

What is claimed is:

1. A power tool, comprising:

a main body portion having an output portion;

a grabbing portion extending from the main body portion;

a battery holding portion provided at a downward portion of the grabbing portion;

a battery provided at a downward portion of the battery holding portion;

a connecting portion being fixed to a rear portion of the battery holding portion and having a hole; and a hook-like portion held at the hole of the connecting portion, wherein said hook-like portion includes a base portion connected to the connecting portion, a bent portion continuous to the base portion, and a front end portion continuous to the bent portion, said front end portion arranged at a position substantially opposed to the base portion, the front end portion and the base portion are made to be able to be proximate to and remote from each other, wherein the connecting portion holds the hook-like portion in a state of being hung down in a direction substantially the same as a direction in which the grabbing portion extends and the hook-like portion is pivotably held, relative to the grabbing portion, on a first pivoting axis center extended in the direction in which the hanging down hook-like portion extends, wherein the connecting portion is rotatably provided between a first position where the battery is proximate to the front end portion and a second position where the battery is spatially apart from the front end portion, wherein the first pivoting axis is provided at the rear portion of the battery holding portion shifted from a center in a right-left direction, and wherein the grabbing portion includes a pinching portion capable of pinching the front end portion of the hook-like portion.

2. The power tool according to claim 1, wherein the connecting portion includes a second pivoting axis center intersecting the first pivoting axis center and the hook-like portion is held pivotably around the second pivoting axis center.

3. The power tool according to claim 1, wherein the hook-like portion is provided in a direction in which the grabbing portion extends.

4. The power tool according to claim 1, wherein the output portion includes an output shaft portion, wherein the grabbing portion extends from the main body portion in a direction which intersects a direction of an output shaft of the output shaft portion, and wherein a second pivoting axis center extends in a direction substantially orthogonal to the direction of the output shaft and the direction in which the grabbing portion extends.

5. The power tool according to claim 1, wherein the hook-like portion is made of plastically-deformable material, and wherein the front end portion and the base portion are made to be able to be proximate to and remote from each other.

* * * * *